US007926548B2

(12) United States Patent
Jacques et al.

(10) Patent No.: US 7,926,548 B2
(45) Date of Patent: Apr. 19, 2011

(54) METHOD AND APPARATUS FOR SEALING AN INGOT AT INITIAL STARTUP

(75) Inventors: Michael P. Jacques, Canton, OH (US); Kuang-O Yu, Highland Heights, OH (US)

(73) Assignee: RTI International Metals, Inc., Niles, OH (US)

( * ) Notice: Subject to any disclaimer, the term of this patent is extended or adjusted under 35 U.S.C. 154(b) by 367 days.

(21) Appl. No.: 12/283,226

(22) Filed: Sep. 10, 2008

(65) Prior Publication Data

US 2009/0008059 A1 Jan. 8, 2009

Related U.S. Application Data

(63) Continuation-in-part of application No. 11/799,574, filed on May 2, 2007, now Pat. No. 7,484,549, which is a continuation-in-part of application No. 11/433,107, filed on May 12, 2006, now Pat. No. 7,484,548, which is a continuation-in-part of application No. 10/989,563, filed on Nov. 16, 2004, now Pat. No. 7,322,397.

(51) Int. Cl.
*B22D 11/00* (2006.01)
*B22D 11/08* (2006.01)

(52) U.S. Cl. ..... 164/475; 164/415; 164/425

(58) Field of Classification Search ..... 164/475, 164/415, 416, 425, 439, 445, 268
See application file for complete search history.

(56) References Cited

U.S. PATENT DOCUMENTS

| | | | | |
|---|---|---|---|---|
| 2,238,155 | A | 4/1941 | Cohen | |
| 2,709,842 | A | 6/1955 | Findlay | |
| 2,858,586 | A * | 11/1958 | Brennan | 164/471 |
| 2,903,759 | A | 9/1959 | Brennan | |
| 3,318,363 | A * | 5/1967 | Goss | 164/472 |
| 3,396,778 | A | 8/1968 | Jensen et al. | |
| 3,470,939 | A | 10/1969 | Coad | |
| 3,888,300 | A | 6/1975 | Guichard et al. | |
| 3,901,305 | A * | 8/1975 | Balevski et al. | 164/415 |
| 4,024,309 | A | 5/1977 | Pender | |
| 4,178,000 | A * | 12/1979 | Kuttner | 277/468 |
| 4,391,319 | A | 7/1983 | Heaslip et al. | |
| 6,868,896 | B2 | 3/2005 | Jackson et al. | |
| 6,920,912 | B2 | 7/2005 | Blejde et al. | |
| 7,004,229 | B2 | 2/2006 | Salee et al. | |
| 7,322,397 | B2 | 1/2008 | Jacques et al. | |
| 7,484,548 | B2 * | 2/2009 | Jacques et al. | 164/268 |
| 7,484,549 | B2 * | 2/2009 | Jacques et al. | 164/416 |
| 2002/0036073 | A1 | 3/2002 | Takeuchi et al. | |
| 2006/0254746 | A1 | 11/2006 | Jacques et al. | |

* cited by examiner

*Primary Examiner* — Kevin P Kerns
(74) *Attorney, Agent, or Firm* — Sand & Sebolt

(57) ABSTRACT

A continuous casting furnace for producing metal ingots includes a molten seal which prevents external atmosphere from entering the melting chamber. A startup sealing assembly allows an initial seal to be formed to prevent external atmosphere from entering the melting chamber prior to the formation of the molten seal.

31 Claims, 17 Drawing Sheets

METHOD AND APPARATUS FOR SEALING AN INGOT AT INITIAL STARTUP

CROSS REFERENCE TO RELATED APPLICATIONS

This application is a continuation-in-part of U.S. patent application Ser. No. 11/799,574, filed May 2, 2007, now U.S. Pat. No. 7,484,549, which is a continuation-in-part of U.S. patent application Ser. No. 11/433,107, filed May 12, 2006, now U.S. Pat. No. 7,484,548, which is a continuation-in-part of U.S. patent application Ser. No. 10/989,563, filed Nov. 16, 2004 now U.S. Pat. No. 7,322,397; the disclosures of which are incorporated herein by reference.

BACKGROUND OF THE INVENTION

1. Technical Field

The invention relates generally to the continuous casting of metals. More particularly, the invention relates to the protection of reactionary metals from reacting with the atmosphere when molten or at elevated temperatures. Specifically, the invention relates to using a molten material such as liquid glass to form a barrier to prevent the atmosphere from entering the melting chamber of a continuous casting furnace and to coat a metal casting formed from such metals to protect the metal casting from the atmosphere.

2. Background Information

Hearth melting processes, Electron Beam Cold Hearth Refining (EBCHR) and Plasma Arc Cold Hearth Refining (PACHR), were originally developed to improve the quality of titanium alloys used for jet engine rotating components. Quality improvements in the field are primarily related to the removal of detrimental particles such as high density inclusions (HDI) and hard alpha particles. Recent applications for both EBCHR and PACHR are more focused on cost reduction considerations. Some ways to effect cost reduction are increasing the flexible use of various forms of input materials, creating a single-step melting process (conventional melting of titanium, for instance, requires two or three melting steps) and facilitating higher product yield.

Titanium and other metals are highly reactive and therefore must be melted in a vacuum or in an inert atmosphere. In electron beam cold hearth refining (EBCHR), a high vacuum is maintained in the furnace melting and casting chambers in order to allow the electron beam guns to operate. In plasma arc cold hearth refining (PACHR), the plasma arc torches use an inert gas such as helium or argon (typically helium) to produce plasma and therefore the atmosphere in the furnace consists primarily of a partial or positive pressure of the gas used by the plasma torches. In either case, contamination of the furnace chamber with oxygen or nitrogen, which react with molten titanium, may cause hard alpha defects in the cast titanium. Thus, oxygen and nitrogen should be completely or substantially avoided within the furnace chamber throughout the casting process.

In order to permit extraction of the casting from the furnace with minimal interruption to the casting process and no contamination of the melting chamber with oxygen and nitrogen or other gases, current furnaces utilize a withdrawal chamber. During the casting process the lengthening casting moves out of the bottom of the mold through an isolation gate valve and into the withdrawal chamber. When the desired or maximum casting length is reached it is completely withdrawn out of the mold through the gate valve and into the withdrawal chamber. Then, the gate valve is closed to isolate the withdrawal chamber from the furnace melt chamber, the withdrawal chamber is moved from under the furnace and the casting is removed.

Although functional, such furnaces have several limitations. First, the maximum casting length is limited to the length of the withdrawal chamber. In addition, casting must be stopped during the process of removing a casting from the furnace. Thus, such furnaces allow continuous melting operations but do not allow continuous casting. Furthermore, the top of the casting will normally contain shrinkage cavities (pipe) that form when the casting cools. Controlled cooling of the casting top, known as a "hot top", can reduce these cavities, but the hot top is a time-consuming process which reduces productivity. The top portion of the casting containing shrinkage or pipe cavities is unusable material which thus leads to a yield loss. Moreover, there is an additional yield loss due to the dovetail at the bottom of the casting that attaches to the withdrawal ram.

The present invention eliminates or substantially reduces these problems with a sealing apparatus which permits continuous casting of the titanium, superalloys, refractory metals, and other reactive metals whereby the casting in the form of an ingot, bar, slab or the like can move from the interior of a continuous casting furnace to the exterior without allowing the introduction of air or other external atmosphere into the furnace chamber.

BRIEF SUMMARY OF THE INVENTION

The present invention provides a method comprising the steps of positioning first and second spaced annular sealing members abutting and extending radially inwardly from a passage wall inner periphery which defines a passage which communicates with an interior chamber containing a continuous casting mold and with atmosphere external to the interior chamber, the passage comprising a molten seal reservoir between the mold and the sealing members; inserting an ingot starter stub through the sealing members and molten seal reservoir into the interior chamber so that an upper end of the stub is disposed in the mold and each of the sealing members abuts an outer periphery of the starter stub so that at least one of the sealing members forms a substantially airtight seal with the outer periphery of the starter stub; and moving inert gas into a first space defined between the sealing members, the outer periphery of the starter stub and the passage wall inner periphery.

The present invention also provides a method comprising the steps of positioning an annular sealing member abutting and extending radially inwardly from a passage wall inner periphery which defines a passage which communicates with an interior chamber containing a continuous casting mold and with atmosphere external to the interior chamber, the passage comprising a molten seal reservoir between the mold and the sealing member; inserting an ingot starter stub through the sealing member and molten seal reservoir into the interior chamber so that an upper end of the stub is disposed in the mold and the sealing member abuts and forms a substantially airtight seal with the outer periphery of the starter stub to prevent the external atmosphere from entering the interior chamber via the passage; evacuating air from the interior chamber after the step of inserting; backfilling the evacuated interior chamber with inert gas; pouring molten metal into the mold atop the starter stub to initiate formation of a heated metal casting atop the starter stub whereby the metal casting and starter stub together form an ingot; and forming a molten seal within the reservoir around an outer periphery of the ingot which prevents the external atmosphere from entering the interior chamber via the passage whereby the seal between the sealing member and the outer periphery of the starter stub is no longer necessary to prevent the external atmosphere from entering the interior chamber via the passage.

The present invention further provides a furnace comprising an interior chamber; a continuous casting mold within the interior chamber; a passage wall having an inner periphery defining a passage communicating with the interior chamber and with atmosphere external to the interior chamber; a metal casting pathway extending from the mold through the passage and configured for moving a heated metal casting therethrough from the interior chamber to the external atmosphere; first and second spaced annular sealing members removably disposed within the passage; each of the annular members having an inner periphery defining a transverse cross sectional shape which is substantially the same as and about the same size as that of the metal casting pathway; a first space defined between the first and second annular members, the outer periphery of the metal casting pathway and the passage wall inner periphery; and a source of inert gas in fluid communication with the first space.

DETAILED DESCRIPTION OF THE INVENTION

Figure 1:
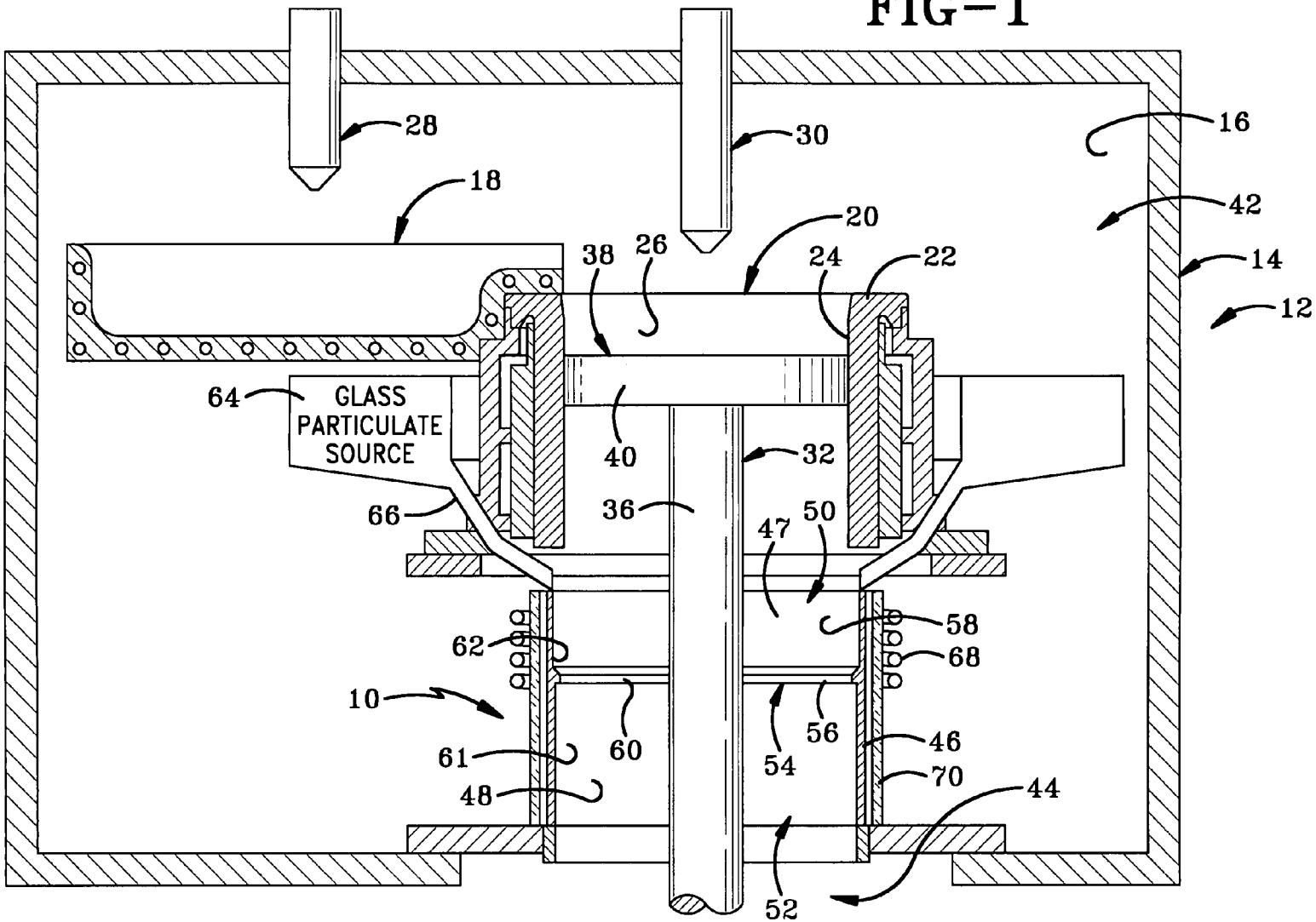
FIG. 1 is a sectional view of the seal of the present invention in use with a continuous casting furnace.

The seal of the present invention is indicated generally at 10 in FIGS. 1-5 in use with a continuous casting furnace 12. Furnace 12 includes a chamber wall 14 which encloses a melting chamber 16 within which seal 10 is disposed. Within melting chamber 16, furnace 12 further includes a melting/refining hearth 18 in fluid communication with a mold 20 having a substantially cylindrical sidewall 22 with a substantially cylindrical inner surface 24 defining a mold cavity 26 therewithin. Heat sources 28 and 30 are disposed respectively above melting/refining hearth 18 and mold 20 for heating and melting reactionary metals such as titanium and superalloys. Heat sources 28 and 30 are preferably plasma torches although other suitable heat sources such as induction and resistance heaters may be used.

Figure 2:
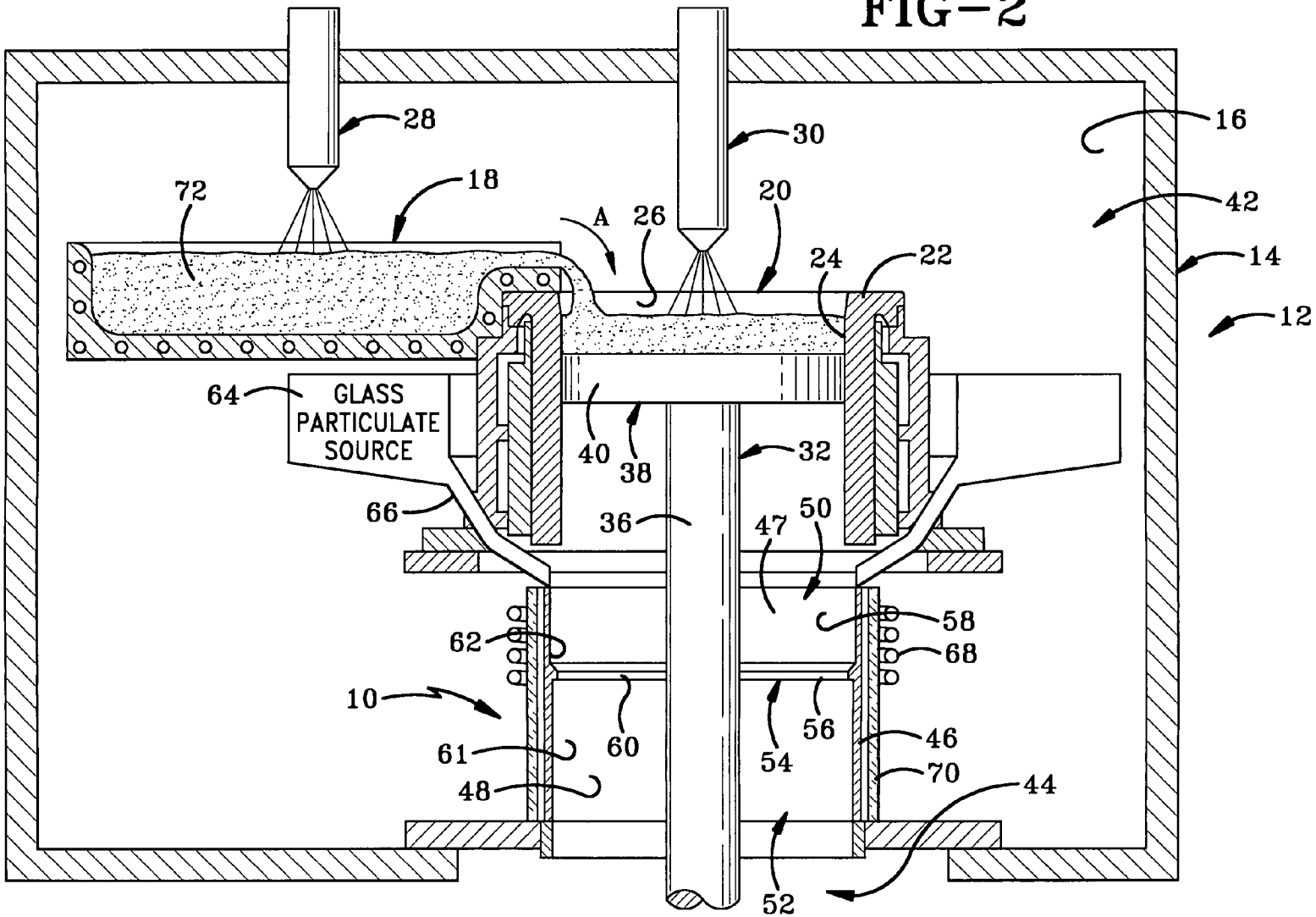
FIG. 2 is similar to FIG. 1 and shows an initial stage of forming an ingot with molten material flowing from the melting/refining hearth into the mold and being heated by heat sources over each of the hearth and mold.
Figure 3:
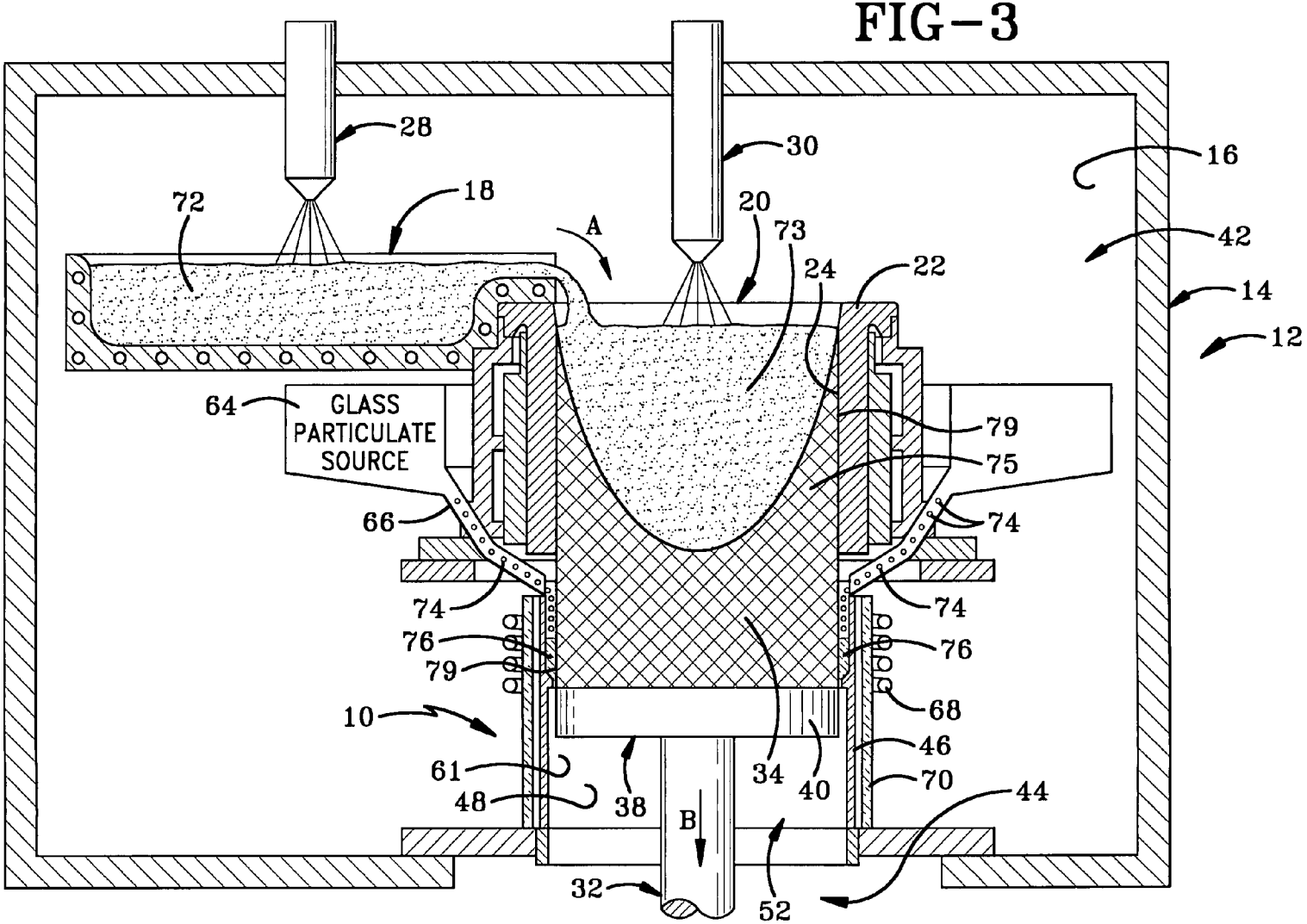
FIG. 3 is similar to FIG. 2 and shows a further stage of formation of the ingot as the ingot is lowered on a lift and into the seal area.
Figure 4:
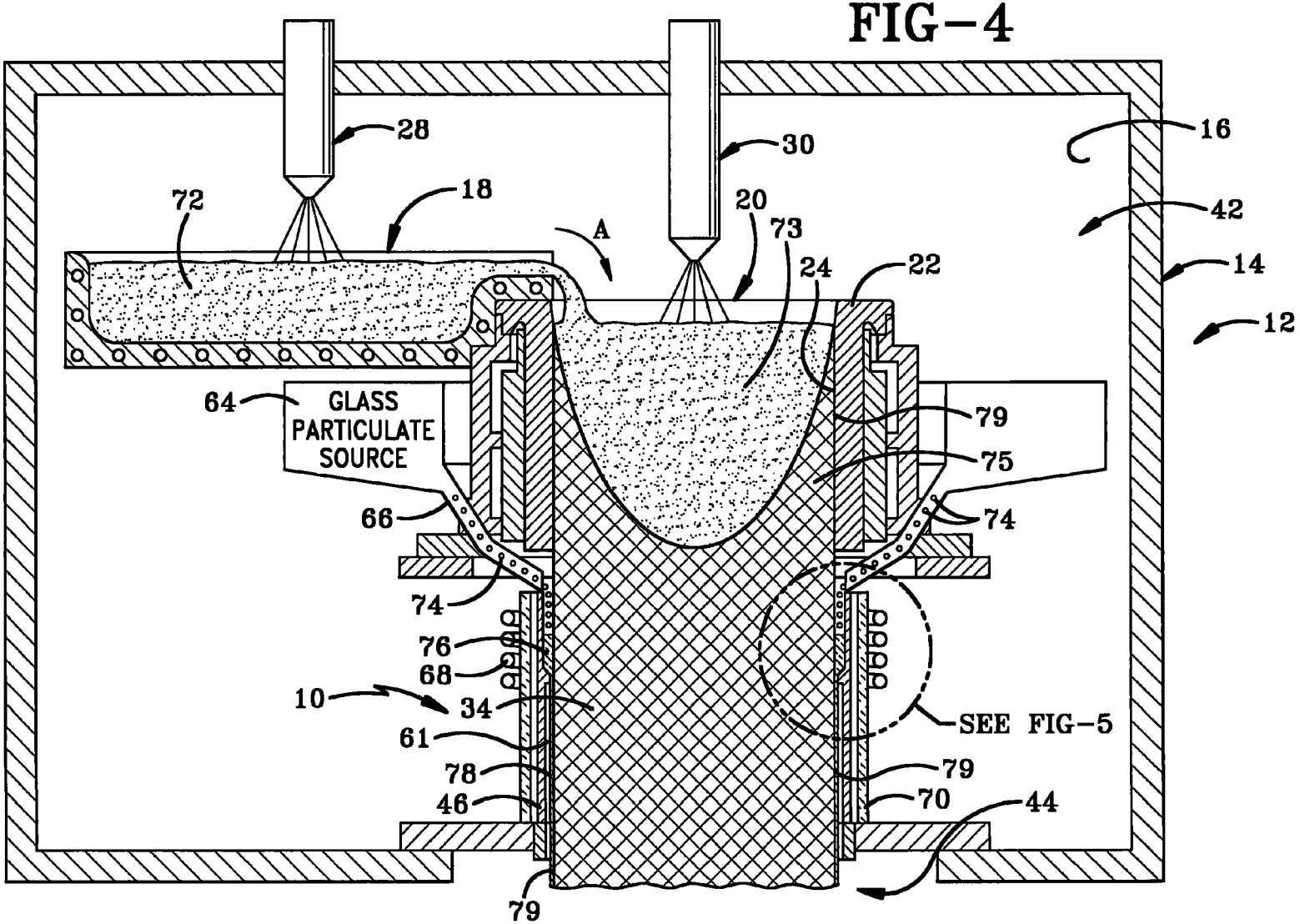
FIG. 4 is similar to FIG. 3 and shows a further stage of formation of the ingot and formation of the glass coating on the ingot.

Furnace 12 further includes a lift or withdrawal ram 32 for lowering a metal casting 34 (FIGS. 2-4). Any suitable withdrawal device may be used. Metal casting 34 may be in any suitable form, such as a round ingot, rectangular slab or the like. Ram 32 includes an elongated arm 36 with a mold support 38 in the form of a substantially cylindrical plate seated atop of arm 36. Mold support 38 has a substantially cylindrical outer surface 40 which is disposed closely adjacent inner surface 24 of mold 20 as ram 32 moves in a vertical direction. During operation, melting chamber 16 contains an atmosphere 42 which is non-reactive with reactive metals such as titanium and superalloys which may be melted in furnace 12. Inert gases may be used to form non-reactive atmosphere 42, particularly when using plasma torches, with which helium or argon are often used, most typically the former. Outside of chamber wall 14 is an atmosphere 44 which is reactive with the reactionary metals when in a heated state.

Seal 10 is configured to prevent reactive atmosphere 44 from entering melting chamber 16 during the continuous casting of reactionary metals such as titanium and superalloys. Seal 10 is also configured to protect the heated metal casting 34 when it enters reactive atmosphere 44. Seal 10 includes a passage wall or port wall 46 having a substantially cylindrical inner surface 47 defining passage 48 therewithin which has an entrance opening 50 and an exit opening 52. Port wall 46 includes an inwardly extending annular flange 54 having an inner surface or circumference 56. Inner surface 47 of port wall 46 adjacent entrance opening 50 defines an enlarged or wider section 58 of passage 48 while flange 54 creates a narrowed section 60 of passage 48. Below annular flange 54, inner surface 47 of port wall 46 defines an enlarged exit section 61 of passage 48.

As later explained, a reservoir 62 for a molten material such as liquid glass is formed during operation of furnace 12 in enlarged section 58 of passage 48. A source 64 of particulate glass or other suitable meltable material such as fused salt or slags is in communication with a feed mechanism 66 which is in communication with reservoir 62. Seal 10 may also include a heat source 68 which may include an induction coil, a resistance heater or other suitable source of heat. In addition, insulating material 70 may be placed around seal 10 to help maintain the seal temperature.

The operation of furnace 12 and seal 10 is now described with reference to FIGS. 2-5. FIG. 2 shows heat source 28 being operated to melt reactionary metal 72 within melting/refining hearth 18. Molten metal 72 flows as indicated by Arrow A into mold cavity 26 of mold 20 and is initially kept in a molten state by operation of heat source 30.

FIG. 3 shows ram 32 being withdrawn downwardly as indicated by Arrow B as additional molten metal 72 flows from hearth 18 into mold 20. An upper portion 73 of metal 72 is kept molten by heat source 30 while lower portions 75 of metal 72 begins to cool to form the initial portions of casting 34. Water-cooled wall 22 of mold 20 facilitates solidification of metal 72 to form casting 34 as ram 32 is withdrawn downwardly. At about the time that casting 34 enters narrowed section 60 (FIG. 2) of passage 48, particulate glass 74 is fed from source 64 via feed mechanism 66 into reservoir 62. While casting 34 has cooled sufficiently to solidify in part, it is typically sufficiently hot to melt particulate glass 74 to form liquid glass 76 within reservoir 62 which is bounded by an outer surface 79 of casting 34 and inner surface 47 of port wall 46. If needed, heat source 68 may be operated to provide additional heat through port wall 46 to help melt particulate glass 74 to ensure a sufficient source of liquid glass 76 and/or help keep liquid glass in a molten state. Liquid glass 76 fills the space within reservoir 62 and narrowed portion 60 to create a barrier which prevents external reactive atmosphere 44 from entering melting chamber 16 and reacting with molten metal 72. Annular flange 54 bounds the lower end of reservoir 62 and reduces the gap or clearance between outer surface 79 of casting 34 and inner surface 47 of port wall 46. The narrowing of passage 48 by flange 54 allows liquid glass 76 to pool within reservoir 62 (FIG. 2). The pool of liquid glass 76 in reservoir 62 extends around metal casting 34 in contact with outer surface 79 thereof to form an annular pool which is substantially cylindrical within passage 48. The pool of liquid glass 76 thus forms a liquid seal. After formation of this seal, a bottom door (not shown) which had been separating non-reactive atmosphere 42 from reactive atmosphere 44 may be opened to allow withdrawal of casting 34 from chamber 16.

Figure 5:
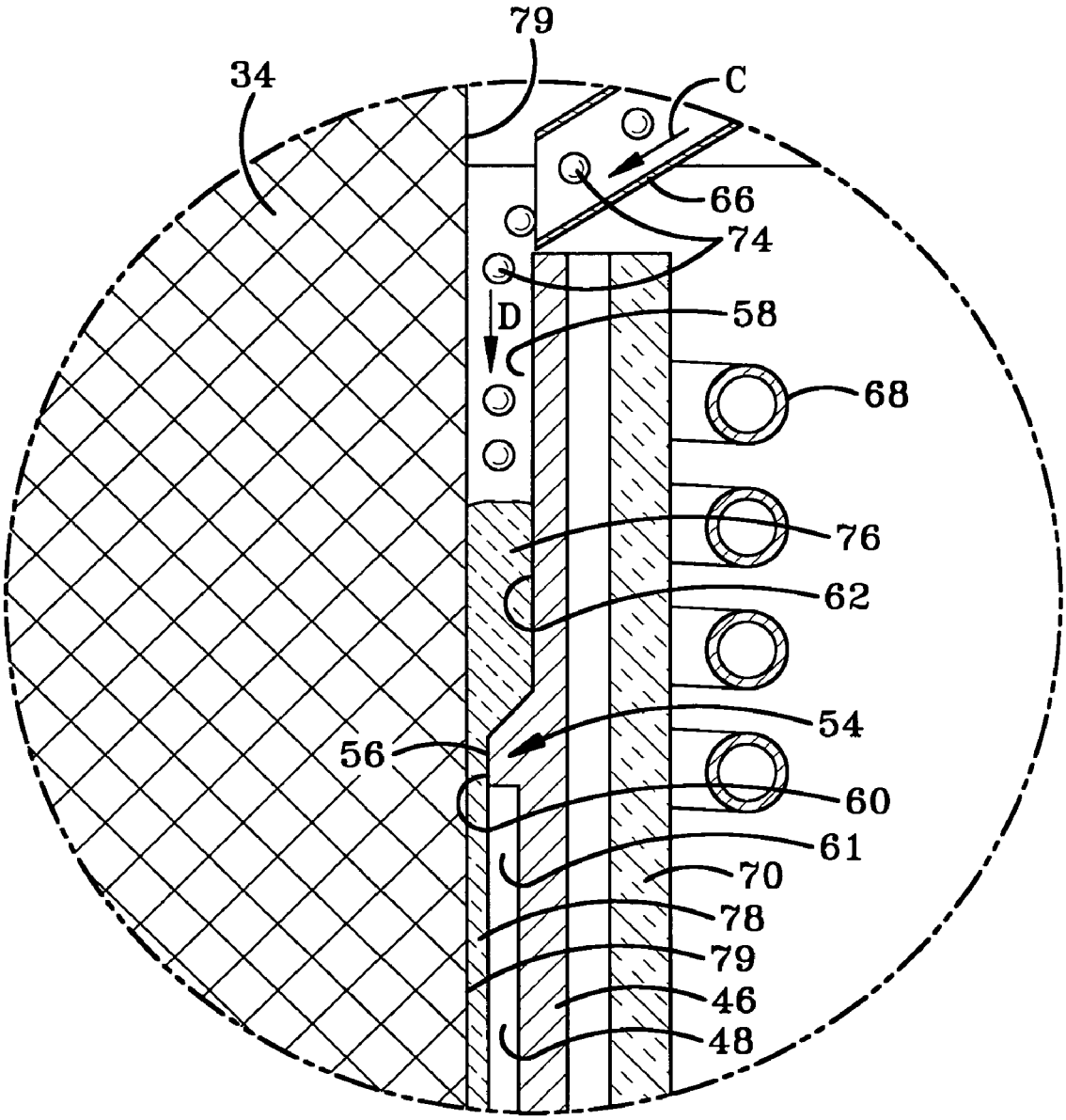
FIG. 5 is an enlarged view of the encircled portion of FIG. 4 and shows particulate glass entering the liquid glass reservoir and the formation of the glass coating.

As casting 34 continues to move downwardly as indicated in FIGS. 4-5, liquid glass 76 coats outer surface 79 of casting 34 as it passes through reservoir 62 and narrowed section 60 of passage 48. Narrowed section 60 reduces the thickness of or thins the layer of liquid glass 76 adjacent outer surface 79 of casting 34 to control the thickness of the layer of glass which exits passage 48 with casting 34. Liquid glass 76 then cools sufficiently to solidify as a solid glass coating 78 on outer surface 79 of casting 34. Glass coating 78 in the liquid and solid states provides a protective barrier to prevent reactive metal 72 forming casting 34 from reacting with reactive atmosphere 44 while casting 34 is still heated to a sufficient temperature to permit such a reaction.

FIG. 5 more clearly shows particulate glass 74 traveling through feed mechanism 66 as indicated by Arrow C and into enlarged section 58 of passage 48 and into reservoir 62 (Arrow D) where particulate glass 74 is melted to form liquid glass 76. FIG. 5 also shows the formation of the liquid glass coating in narrowed section 60 of passage 48 as casting 34 moves downwardly. FIG. 5 also shows an open space between glass coating 78 and port wall 46 within enlarged exit section 61 of passage 48 as casting 34 with coating 78 move through section 61.

Figure 7:
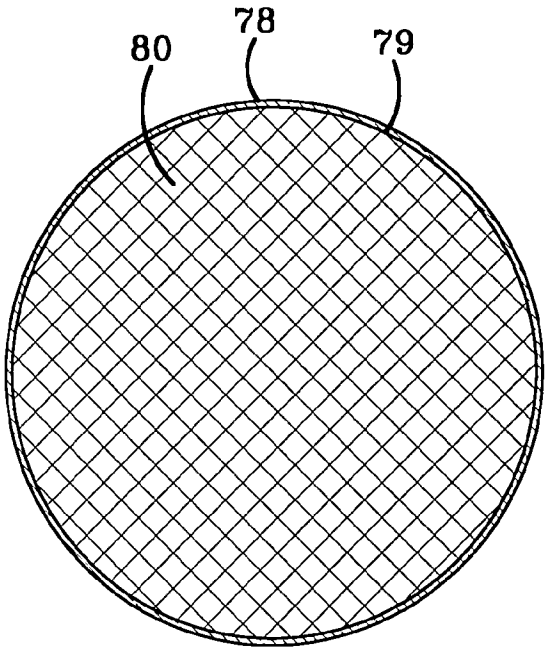
FIG. 7 is a sectional view taken on line 7-7 of FIG. 6.
Figure 6:
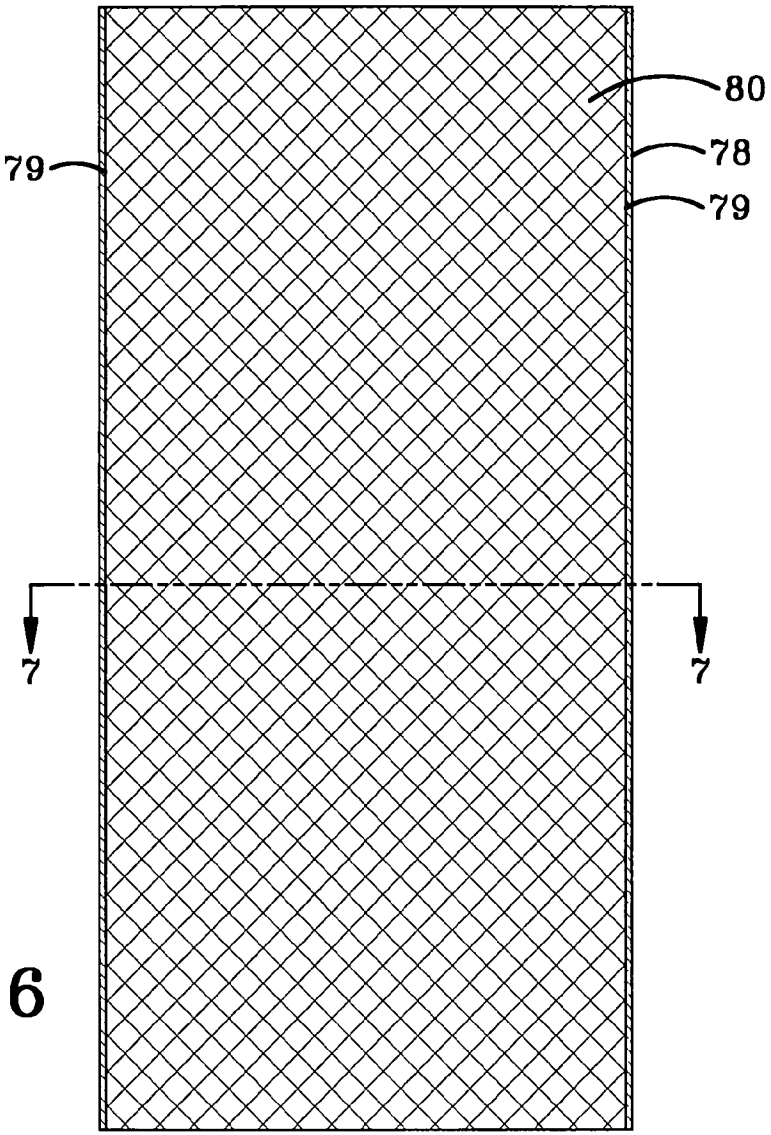
FIG. 6 is a sectional view of the ingot after being removed from the melting chamber of the furnace showing the glass coating on the outer surface of the ingot.

Once casting 34 has exited furnace 12 to a sufficient degree, a portion of casting 34 may be cut off to form an ingot 80 of any desired length, as shown in FIG. 6. As seen in FIGS. 6 and 7, solid glass coating 78 extends along the entire circumference of ingot 80.

Thus, seal 10 provides a mechanism for preventing the entry of reactive atmosphere 44 into melting chamber 16 and also protects casting 34 in the form of an ingot, bar, slab or the like from reactive atmosphere 44 while casting 34 is still heated to a temperature where it is still reactive with atmosphere 44. As previously noted, inner surface 24 of mold 20 is substantially cylindrical in order to produce a substantially cylindrical casting 34. Inner surface 47 of port wall 46 is likewise substantially cylindrical in order to create sufficient space for reservoir 62 and space between casting 34 and inner surface 56 of flange 54 to create the seal and also provide a coating of appropriate thickness on casting 34 as it passes downwardly. Liquid glass 76 is nonetheless able to create a seal with a wide variety of transverse cross-sectional shapes other than cylindrical. The transverse cross-sectional shapes of the inner surface of the mold and the outer surface of the casting are preferably substantially the same as the transverse cross-sectional shape of the inner surface of the port wall, particularly the inner surface of the inwardly extending annular flange in order that the space between the casting and the flange is sufficiently small to allow liquid glass to form in the reservoir and sufficiently enlarged to provide a glass coating thick enough to prevent reaction between the hot casting and the reactive atmosphere outside of the furnace. To form a metal casting suitably sized to move through the passage, the transverse cross-sectional shape of the inner surface of the mold is smaller than that of the inner surface of the port wall.

Additional changes may be made to seal 10 and furnace 12 which are still within the scope of the present invention. For example, furnace 12 may consist of more than a melting chamber such that material 72 is melted in one chamber and transferred to a separate chamber wherein a continuous casting mold is disposed and from which the passage to the external atmosphere is disposed. In addition, passage 48 may be shortened to eliminate or substantially eliminate enlarged exit section 61 thereof. Also, a reservoir for containing the molten glass or other material may be formed externally to passage 48 and be in fluid communication therewith whereby molten material is allowed to flow into a passage similar to passage 48 in order to create the seal to prevent external atmosphere from entering the furnace and to coat the exterior surface of the metal casting as it passes through the passage. In such a case, a feed mechanism would be in communication with this alternate reservoir to allow the solid material to enter the reservoir to be melted therein. Thus, an alternate reservoir may be provided as a melting location for the solid material. However, reservoir 62 of seal 10 is simpler and makes it easier to melt the material using the heat of the metal casting as it passes through the passage.

The seal of the present invention provides increased productivity because a length of the casting can be cut off outside the furnace while the casting process continues uninterrupted. In addition, yield is improved because the portion of each casting that is exposed when cut does not contain shrinkage or pipe cavities and the bottom of the casting does not have a dovetail. In addition, because the furnace is free of a withdrawal chamber, the length of the casting is not limited by such a chamber and thus the casting can have virtually any length that is feasible to produce. Further, by using an appropriate type of glass, the glass coating on the casting may provide lubrication for subsequent extrusion of the casting. Also the glass coating on the casting may provide a barrier when subsequently heating the casting prior to forging to prevent reaction of the casting with oxygen or other atmosphere.

While the preferred embodiment of the seal of the present invention has been described in use with glass particulate matter to form a glass coating, other materials may be used to form the seal and glass coating, such as fused salt or slags for instance.

The present apparatus and process is particularly useful for highly reactive metals such as titanium which is very reactive with atmosphere outside the melting chamber when the reactionary metal is in a molten state. However, the process is suitable for any class of metals, e.g. superalloys, wherein a barrier is needed to keep the external atmosphere out of the melting chamber to prevent exposure of the molten metal to the external atmosphere.

Figure 8:
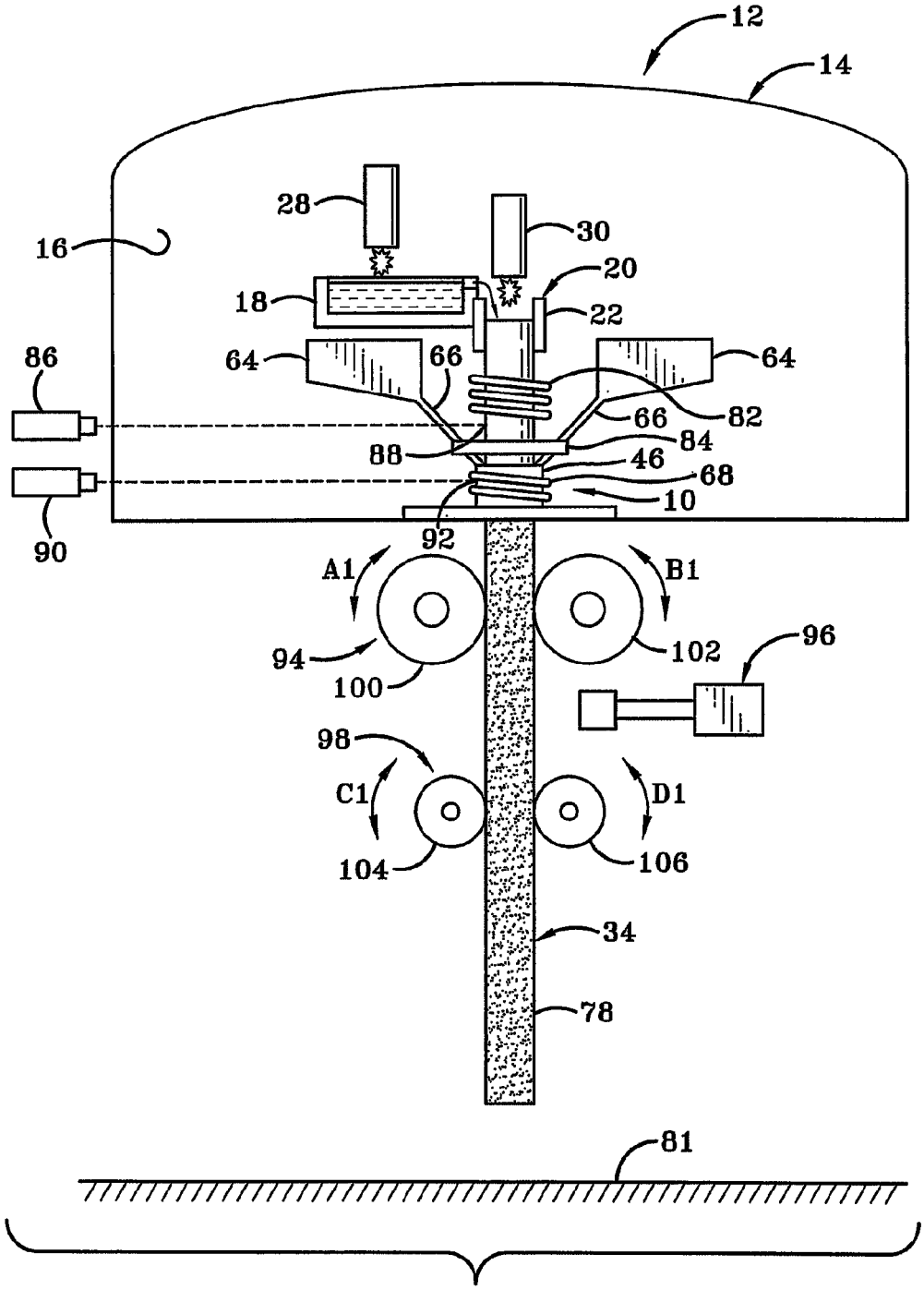
FIG. 8 is a diagrammatic elevational view of the continuous casting furnace of the present invention showing the ingot drive mechanism, the ingot cutting mechanism and the ingot handling mechanism with the newly produced coated metal casting extending downwardly external to the melting chamber and supported by the ingot drive mechanism and ingot handling mechanism.

With reference to FIG. 8, casting furnace 12 is further described. Furnace 12 is shown in an elevated position above a floor 81 of a manufacturing facility or the like. Within interior chamber 16, furnace 12 includes an additional heat source in the form of an induction coil 82 which is disposed below mold 20 and above port wall 46. Induction coil 82 circumscribes the pathway through which metal casting 34 passes during its travel toward the passage within passage wall 46. Thus, during operation, induction coil 82 circumscribes metal casting 34 and is disposed adjacent the outer periphery of the metal casting for controlling the heat of metal casting 34 at a desired temperature for its insertion into the passage in which the molten bath is disposed.

Also within interior chamber 16 is a cooling device in the form of a water cooled tube 84 which is used for cooling conduit 66 of the feed mechanism or dispenser of the particulate material in order to prevent the particulate material from melting within conduit 66. Tube 84 is substantially an annular ring which is spaced outwardly from metal casting 34 and contacts conduit 66 in order to provide for a heat transfer between tube 84 and conduit 66 to provide the cooling described.

Furnace 12 further includes a temperature sensor in the form of an optical pyrometer 86 for sensing the heat of the outer periphery of metal casting 34 at a heat sensing location 88 disposed near induction coil 82 and above port wall 46. Furnace 12 further includes a second optical pyrometer 90 for sensing the temperature at another heat sensing location 92 of port wall 46 whereby pyrometer 90 is capable of estimating the temperature of the molten bath within reservoir 62.

External to and below the bottom wall of chamber wall 14, furnace 12 includes an ingot drive system or lift 94, a cutting mechanism 96 and a removal mechanism 98. Lift 94 is configured to lower, raise or stop movement of metal casting 34 as desired. Lift 94 includes first and second lift rollers 100 and 102 which are laterally spaced from one another and are rotatable in alternate directions as indicated by Arrows A1 and B1 to provide the various movements of metal casting 34. Rollers 100 and 102 are thus spaced from one another approximately the same distance as the diameter of the coated metal casting and contact coating 78 during operation. Cutting mechanism 96 is disposed below rollers 100 and 102 and is configured to cut metal casting 34 and coating 78. Cutting mechanism 96 is typically a cutting torch although other suitable cutting mechanisms may be used. Removal mechanism 98 includes first and second removal rollers 104 and 106 which are spaced laterally from one another in a similar fashion as rollers 100 and 102 and likewise engage coating 78 of the coated metal casting as it moves therebetween. Rollers 104 and 106 are rotatable in alternate directions as indicated at Arrows C1 and D1.

Additional aspects of the operation of furnace 12 are described with reference to FIGS. 8-10. Referring to FIG. 8, molten metal is poured into mold 20 as previously described to produce metal casting 34. Casting 34 then moves downwardly along a pathway from mold 20 through the interior space defined by induction coil 82 and into the passage defined by passage wall 46. Induction coils 82 and 68 and pyrometers 86 and 90 are part of a control system for providing optimal conditions to produce the molten bath within reservoir 62 to provide the liquid seal and coating material which ultimately forms protective barrier 78 on metal casting 34. More particularly, pyrometer 86 senses the temperature at location 88 on the outer periphery of metal casting 34 while pyrometer 90 senses the temperature of passage wall 46 at location 92 in order to assess the temperature of the molten bath within reservoir 62. This information is used to control the power to induction coils 82 and 68 to provide the optimal conditions noted above. Thus, if the temperature at location 88 is too low, induction coil 82 is powered to heat metal casting 34 to bring the temperature at location 88 into a desired range. Likewise, if the temperature at location 88 is too high, the power to induction coil 82 is reduced or turned off. Preferably, the temperature at location 88 is maintained within a given temperature range. Likewise, pyrometer 90 assesses the temperature at location 92 to determine whether the molten bath is at a desired temperature. Depending on the temperature at location 92, the power to induction coil 68 may be increased, reduced or turned off altogether to maintain the temperature of the molten bath within a desired temperature range. As the temperature of metal casting 34 and the molten bath is being controlled, water cooled-tube 84 is operated to provide cooling to conduit 66 in order to allow particulate material from source 64 to reach the passage within passage wall 46 in solid form to prevent clogging of conduit 66 due to melting therein.

With continued reference to FIG. 8, the metal casting moves through seal 10 in order to coat metal casting 34 to produce the coated metal casting which moves downwardly into the external atmosphere and between rollers 100 and 102, which engage and lower the coated metal casting downwardly in a controlled manner. The coated metal casting continues downwardly and is engaged by rollers 104 and 106.

Figure 9:
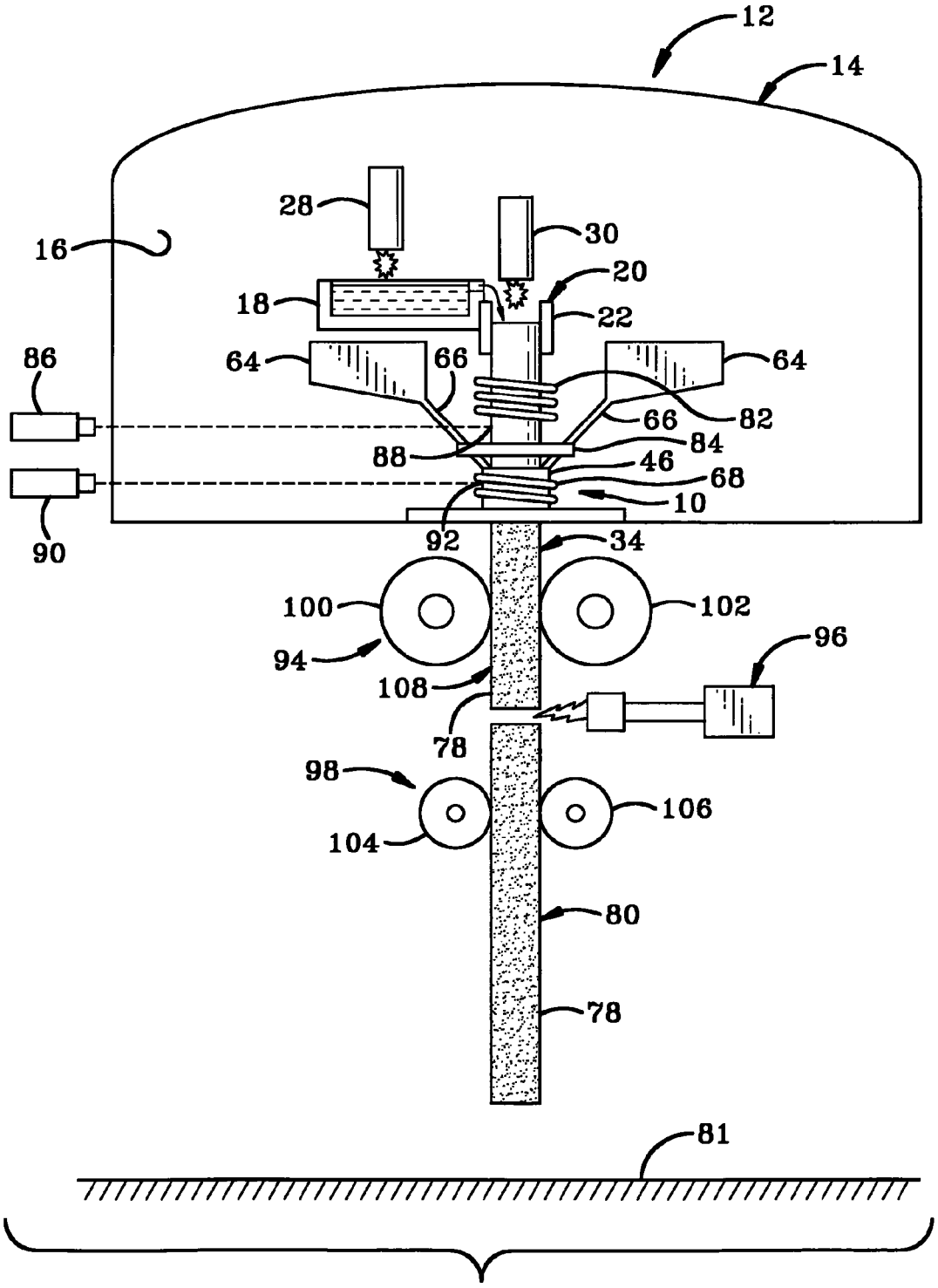
FIG. 9 is similar to FIG. 8 and shows a segment of the coated metal casting having been cut by the cutting mechanism.
Figure 10:
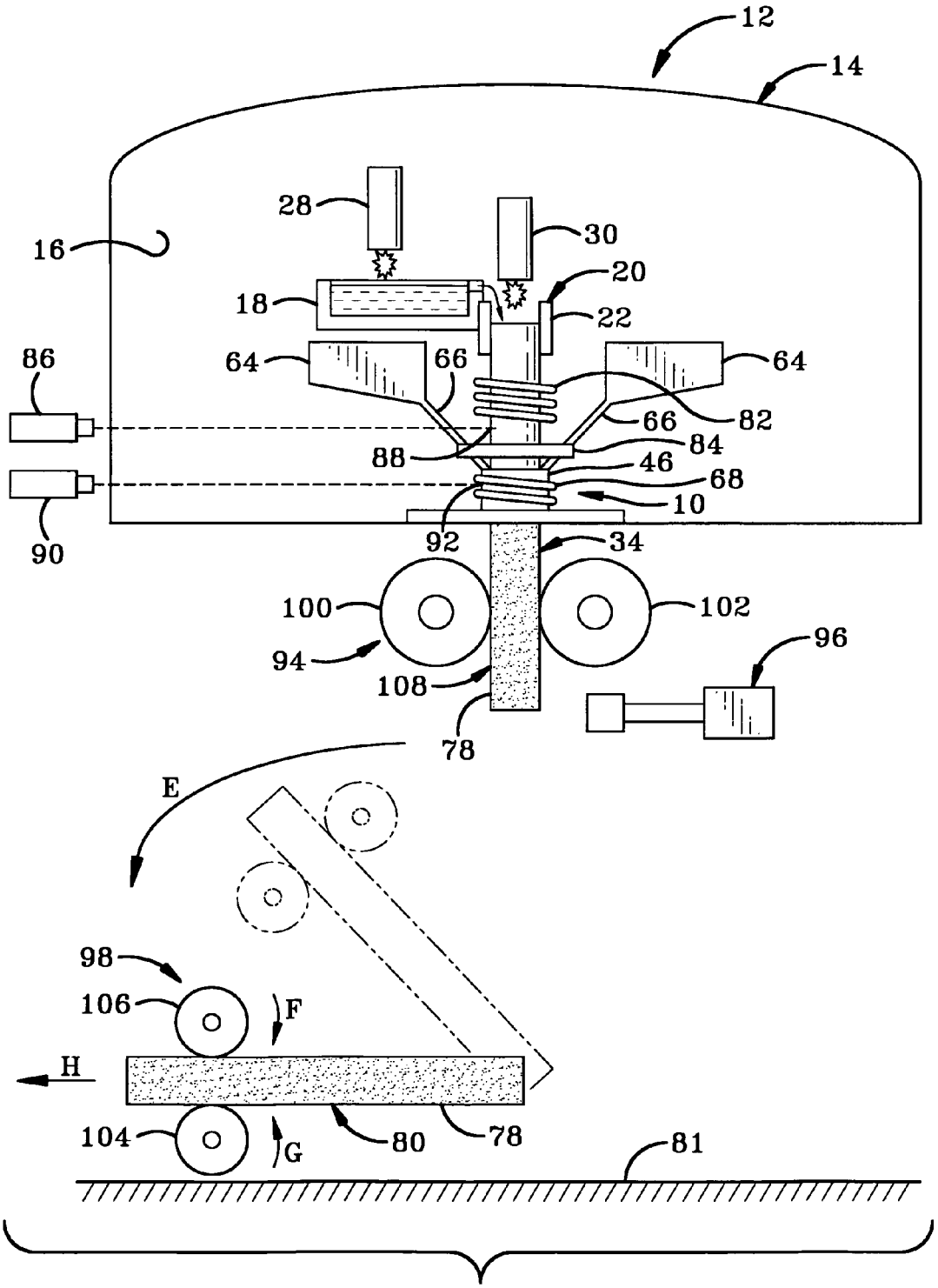
FIG. 10 is similar to FIG. 9 and shows the cut segment having been lowered for convenient handling thereof.

Referring to FIG. 9, cutting mechanism 96 then cuts the coated metal casting to form a cut segment in the form of coated ingot 80. Thus, by the time the coated metal casting reaches the level of cutting mechanism 96, it has cooled to a temperature at which the metal is substantially non-reactive with the external atmosphere. FIG. 9 shows ingot 80 in a cutting position in which ingot 80 has been separated from the parent segment 108 of metal casting 34. Rollers 104 and 106 then rotate as a unit from the receiving or cutting position shown in FIG. 9 downwardly toward floor 81 as indicated by Arrow E in FIG. 10 to a lowered unloading or discharge position in which ingot 80 is substantially horizontal. Rollers 104 and 106 are then rotated as indicated at Arrows F and G to move ingot 80 (Arrow H) to remove ingot 80 from furnace 12 so that rollers 104 and 106 may return to the position shown in FIG. 9 for receiving an additional ingot segment. Removal mechanism 98 thus moves from the ingot receiving position of FIG. 9 to the ingot unloading position of FIG. 10 and back to the ingot receiving position of FIG. 9 so that the production of metal casting 34 and the coating thereof via the molten bath is able to continue in a non-stop manner.

Figure 11:
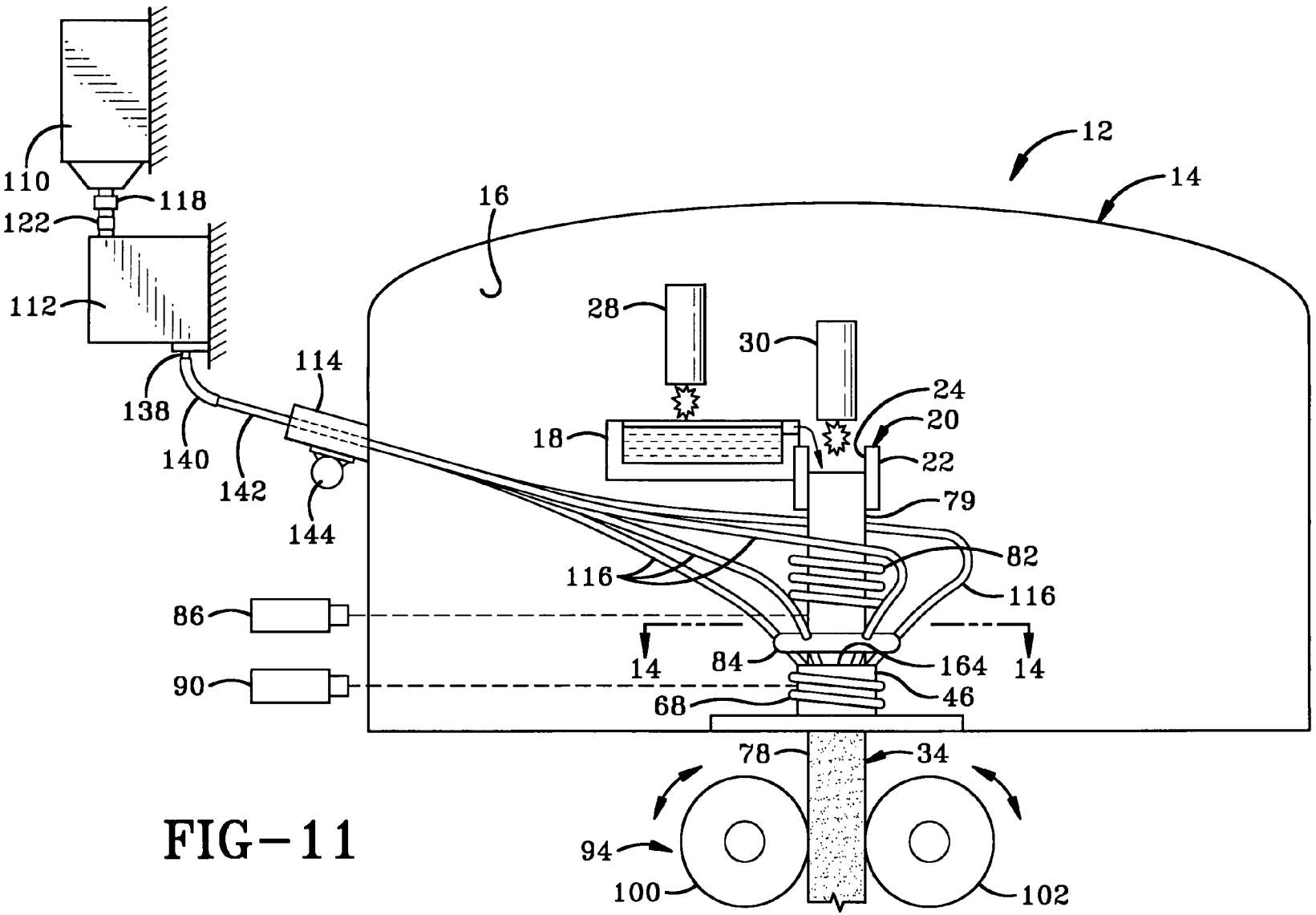
FIG. 11 is an enlarged diagrammatic elevational view similar to FIGS. 8-10 showing the feed system of the invention in greater detail.

The feed mechanism for feeding the solid particulate material of the present invention is now described in greater detail with reference to FIGS. 11-14. Referring to FIG. 11, the feed mechanism includes a hopper 110, a feed chamber 112, a mounting block 114 which is mounted on chamber wall 14 typically via welding, and a plurality of feed tubes 116 each of which is connected to and passes through cooling device 84. Four of feed tubes 116 are shown in FIG. 11 while all six of them are shown in FIG. 14. In practice, the number of feed tubes is typically between four and eight. These various elements of the feed mechanism provide a feed path through which the particles and solid coating material are fed into reservoir 62. Hopper 110, feed chamber 112 and feed tubes 116 are all sealed together with chamber 14 so that the atmosphere within each of these elements of the apparatus is the same. Typically, this atmosphere includes one of argon or helium and may be under a vacuum such as that associated with the use of plasma torches.

Figure 12:
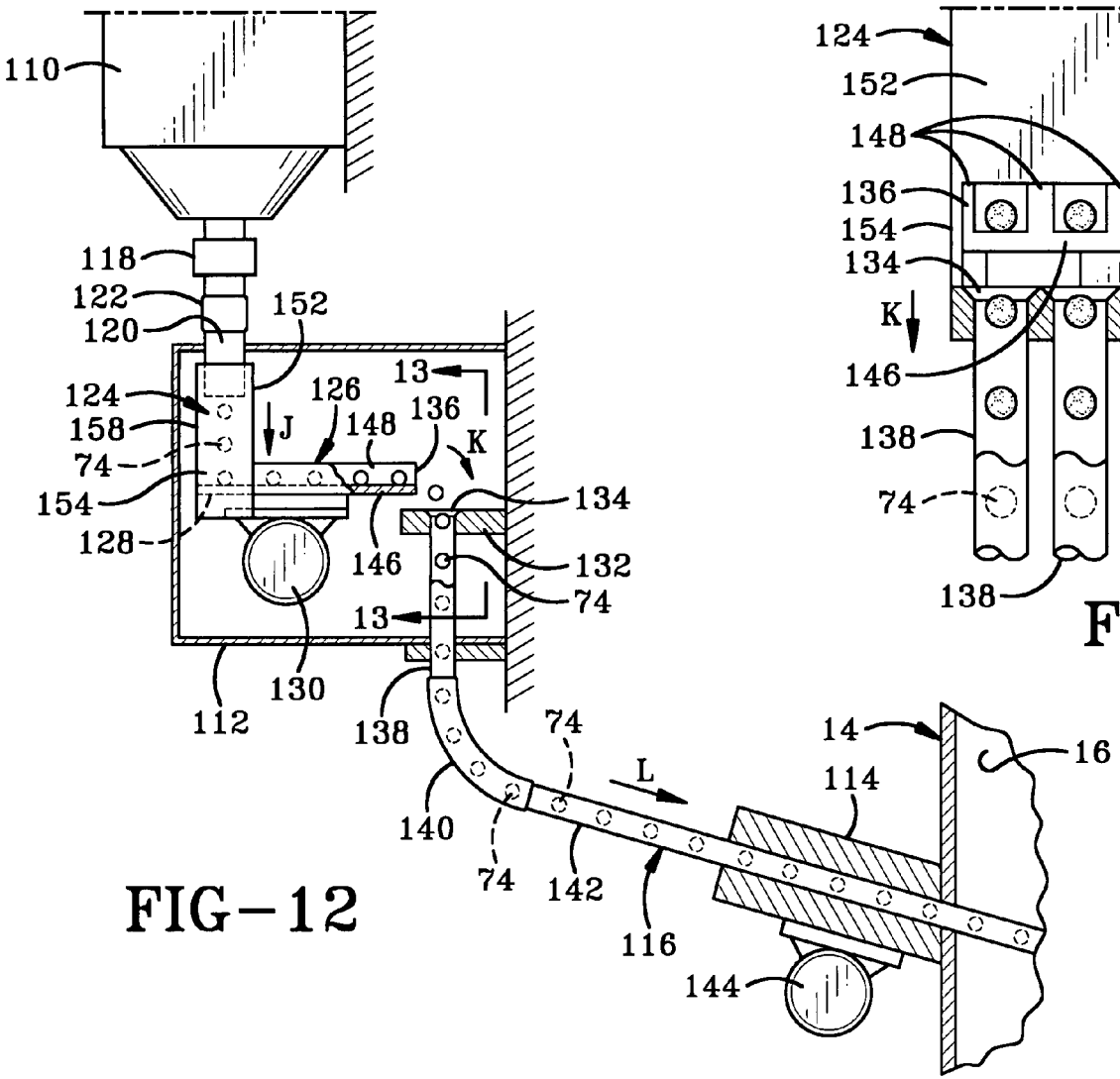
FIG. 12 is an enlarged fragmentary side elevational view of the hopper, feed chamber, feed tube and vibrators with portions shown in section.

Referring to FIG. 12, hopper 110 includes an exit port which is typically controlled by a valve 118. The exit port of hopper 110 communicates with a pipe mounted on the top wall of chamber 112 to provide an entry port 120 into said chamber. The connection between hopper 110 and entry port 120 preferably utilizes an annular coupler 122 which may be formed as an elastomeric material which maintains the seal between hopper 110 and chamber 112 and allows for the removability of hopper 110 to be replaced with another hopper to expedite the switchover process during refilling of hopper 110. Entry port 120 feeds into a container or housing 124 disposed within chamber 112 which is connected to a vibratory feed tray 126 and extends upwardly from an entry end 128 thereof. A variable speed vibrator 130 is mounted on the bottom of tray 126 for vibrating said tray. A feed block 132 is mounted within chamber 112 and defines a plurality of beveled feed holes 134 below to an exit end 136 of tray 126. Each feed tube 116 includes a first tube segment 138 connected to feed block 132 in communication with holes 134. Each first tube segment 138 is connected to the bottom wall of chamber 112 and extends therethrough. Each feed tube 116 further includes a second flexible tube segment 140 connected to an exit end of first segment 138 and a third tube segment 142 connected to an exit end of flexible segment 140. Flexible segments 140 in part compensate for any misalignment between respective first and third segments 138 and 142. Each tube segment 142 extends continuously from a second tube segment 140 to an exit end above end wall 46 (FIG. 11). Thus, block 114 has a plurality of passages formed therethrough through which segments 142 extend. Another vibrator 144 is mounted on the bottom of block 114 to vibrate said block and tube segments 142.

Figure 13:
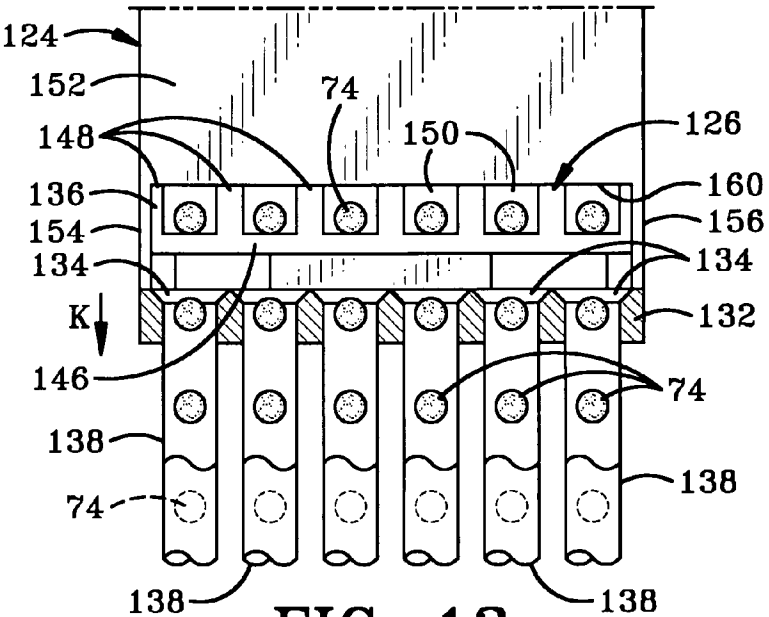
FIG. 13 is a sectional view taken on line 13-13 of FIG. 12.
Figure 14:
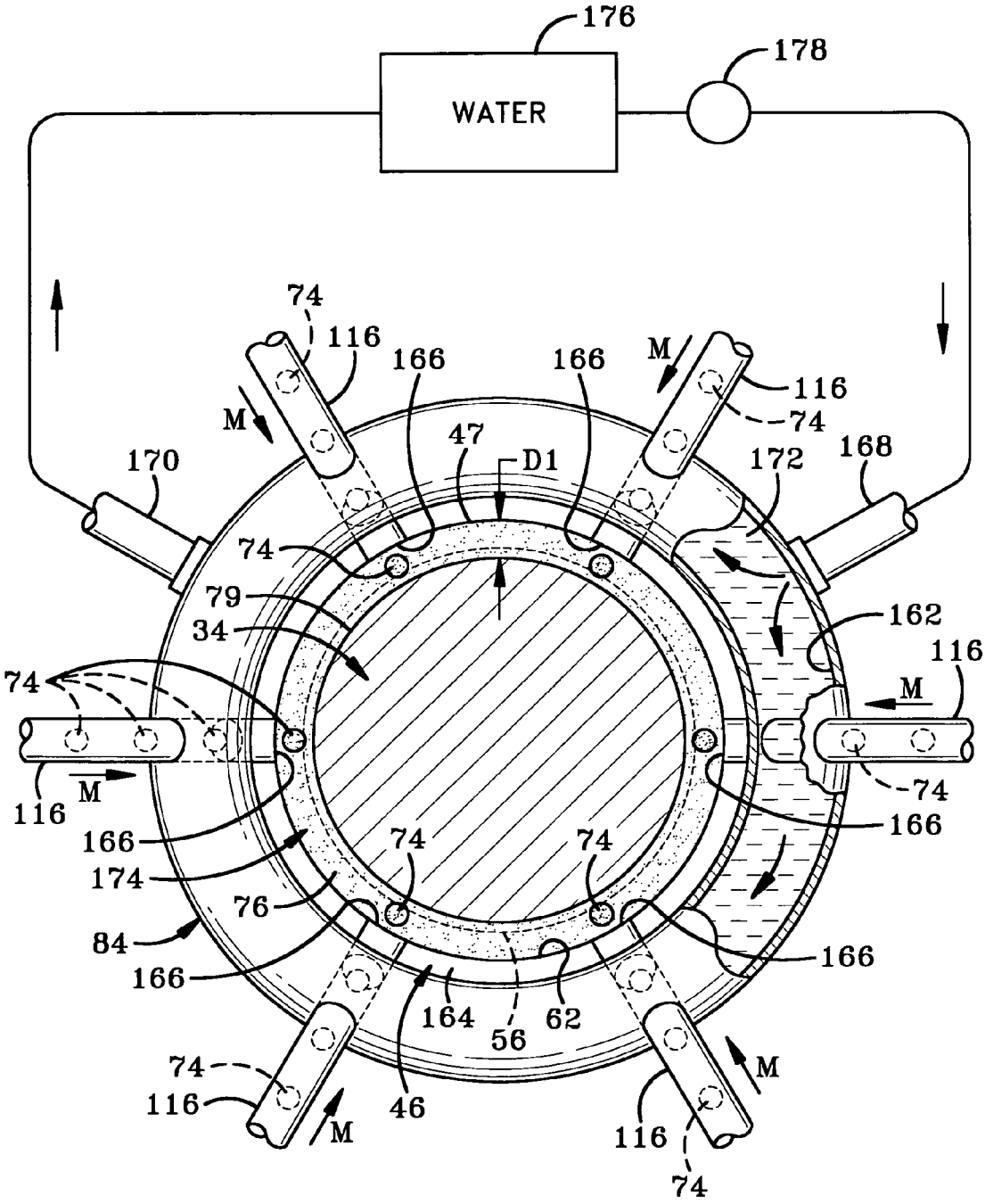
FIG. 14 is sectional view taken on line 14-14 of FIG. 11.
Figure 15:
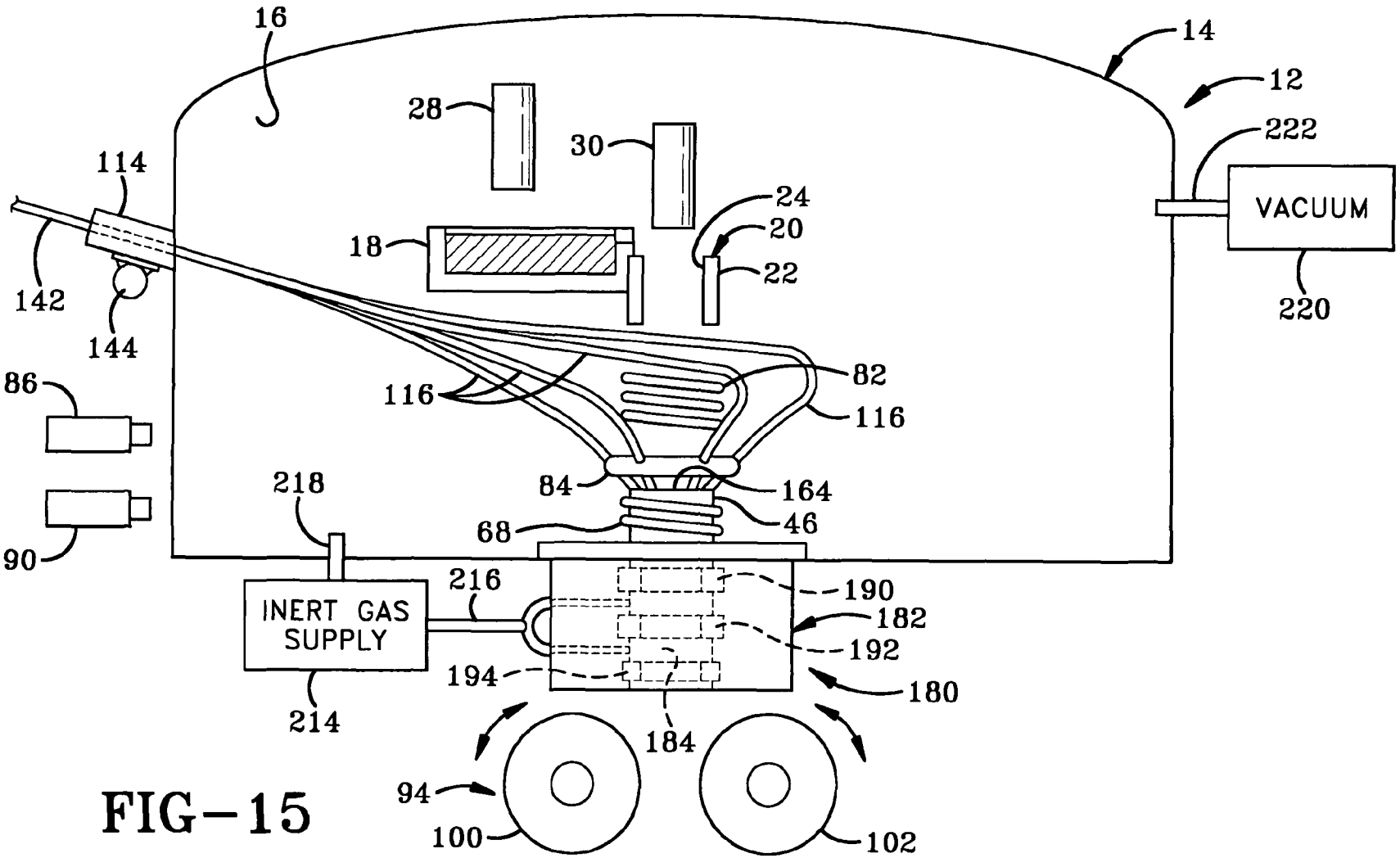
FIG. 15 is similar to FIG. 11 and shows the startup assembly used in the initial formation of an ingot using the molten seal of the present invention.
Figure 16:
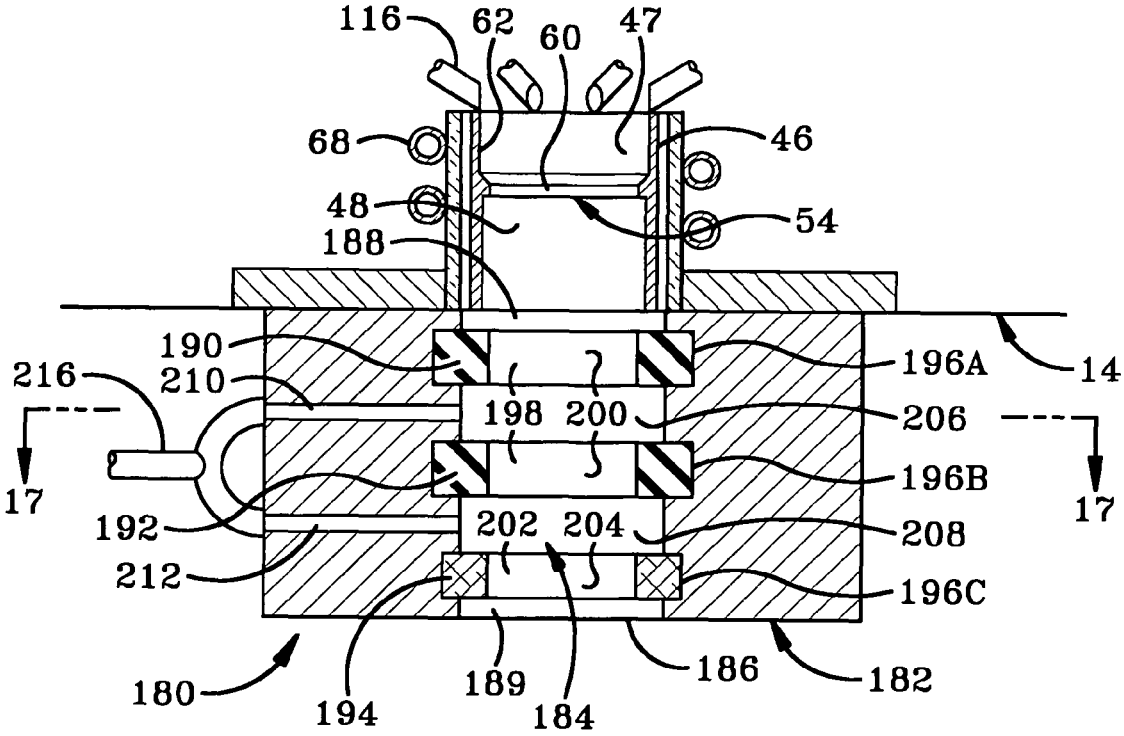
FIG. 16 is an enlarged sectional view taken from the side of the vacuum seal flange of the startup assembly.
Figure 17:
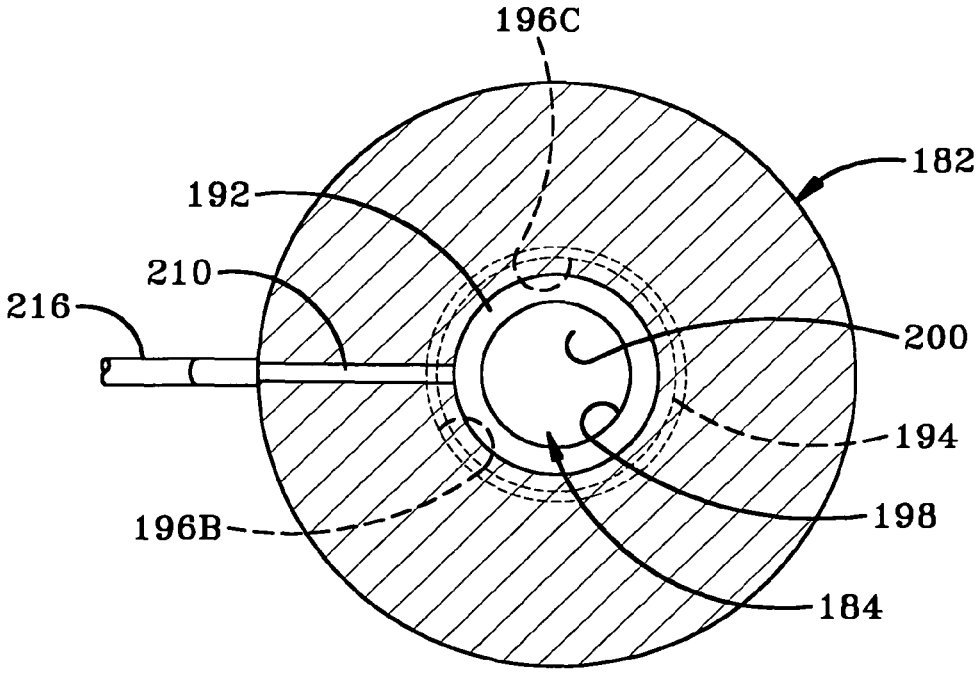
FIG. 17 is a sectional view taken on line 17-17 of FIG. 16.

Referring to FIG. 13, housing 124 and feed tray 126 are described in further detail. Tray 126 includes a substantially horizontal bottom wall 146 and seven channel walls 148 defining therebetween six channels 150 each extending from entry end 128 to exit end 136. While the dimensions of channels 150 may vary, in the exemplary embodiment they are approximately one half inch wide and one half inch high. Housing 124 includes a front wall 152, a pair of side walls 154 and 156 connected thereto and a rear wall 158 (FIG. 12) connected to each of side walls 154 and 156. Side walls 154 and 156 and rear wall 158 extend downwardly to abut bottom wall 146 of tray 126. However, front wall 152 has a bottom edge 160 which is seated atop channel wall 148 to create exit openings each bounded by bottom edge 160, bottom wall 146 and a pair of adjacent channel walls 148.

Referring to FIG. 14, cooling ring 84 is further described. Ring 84 has an annular configuration and is of a tubular structure which defines an annular passage 162. Ring 84 circumscribes the metal casting pathway through which metal casting 34 passes during the casting process. Ring 84 is disposed fairly close to casting 34 and a top surface 164 of wall 46 in order to provide cooling to feed tubes 116 adjacent respective exit ends 166 thereof. Ring 84 has entry and exit ports 168 and 170 to allow for the circulation of water 172 through ring 84. Entry port 168 is in communication with a source 176 of water and a pump 178 for pumping the water through ring 84 indicated by corresponding arrows in FIG. 14. A plurality of holes are formed in the side wall of ring 84 through which the smaller diameter feed tubes 116 pass in order to allow water 172 to directly contact feed tubes 116 adjacent their exit ends 166. Each feed tube 116 adjacent exit end 166 is closely adjacent or in abutment with top surface 164 of wall 46. Each exit end 166 and inner surface 47 of port wall 46 is spaced from outer periphery 79 of metal casting 34 by a distance D1 shown in FIG. 14. Distance D1 is typically in the range of ½ to ¾ inch and preferably is no more than one inch.

Furnace 12 is configured with a metal casting pathway which extends downwardly from the bottom of mold 20 and through the passage of reservoir wall 46. This pathway has a horizontal cross sectional shape which is the same as outer periphery 79 of casting 34, which is substantially identical to the cross sectional shape of inner surface 24 of casting mold 20. Thus, distance D1 also represents the distance from the metal casting pathway to inner surface 47 of wall 46 and the distance between said pathway and exit ends 166 of feed tubes 116.

The particulate coating material is shown as substantially spherical particles 74 which are fed along the feed path from hopper 110 to reservoir 62. It has been found that a soda-lime glass works well as the coating material due in part to the availability of such glass in substantially spherical form. Due to the relatively long pathway along which particles 74 must travel while maintaining control of their flow downstream toward reservoir 62, the use of spherical particles 74 has been found to greatly facilitate the feeding process through conduits 116 which are positioned at an angle suitable to maintain this controlled flow. The segments 142 of feed tubes 116 are disposed along a generally constant angle in spite of the diagrammatic view shown in FIG. 11. Particles 74 have a particle size somewhere within the range of 5 to 50 mesh; and more typically within narrower ranges such as, for example, 8 to 42 mesh; 10 to 36 mesh; 12 to 30 mesh; 14 to 24 mesh and most preferably 16 to 18 mesh.

The operation of the feed system is now described with reference to FIGS. 11-14. Initially, hopper 110 is filled with a substantial amount of particles 74 and valve 118 is positioned to allow the flow thereof via entry port 120 into housing 124 in chamber 112 as indicated at arrow J so that housing 124 becomes partially filled with particles 74. Vibrator 130 is then operated at a desired vibrational rate to vibrate tray 126 and particles 74 to facilitate their movement along channels 150 toward exit end 136, where particles 74 fall off of tray 126 and into tube segments 138 via holes 134 as indicated at arrows K in FIGS. 12 and 13. Particles 74 continue their movement through tube segments 140 and into tube segments 142 as indicated at arrow L toward block 114. Vibrator 144 is operated to vibrate block 114, tube segments 142 and particles 74 passing therethrough to additionally facilitate their movement toward reservoir 62. The spherical shape of particles 74 allows them to roll through conduits 116 and along the various other surfaces of the feed path, substantially facilitating their travel.

Particles 74 complete their travel along the feed path (arrows M) as they reach ends 166 and exit feed tubes 116 therefrom, as shown in FIG. 14. Particles 74 are pre-heated as they travel through segments 142 within the melting chamber, which is accentuated by their small size. However, particles 74 are maintained in the solid state until after they move beyond ends 166 to insure that feed tubes 116 do not become clogged with molten coating material. To insure that particles 74 do not melt within feed tube 116 adjacent exit ends 166, and to insure the integrity of feed tubes 116 in that region, pump 178 (FIG. 14) is operated to pump water from source 176 through ring 84 via entry and exit ports 168 and 170 so that water 172 directly contacts the outer perimeters of feed tubes 116 where they pass through passage 162 of ring 84. Thus, particles 74 are in the solid state at a distance from outer periphery 79 of metal casting 34 which is even less than distance D1. However, particles 74 are rapidly melted largely due to the heat radiating from the newly formed casting 34, with any additional heat needed provided by coil 68. Particles 74 thus are melted at a melting location 174 bounded by outer surface 79 of casting 34 and inner surface 47 of port wall 46, thus within distance D1 of outer periphery 79 of metal casting 34.

Another aspect of the present invention is illustrated in FIGS. 15-20 and is related to providing a seal around the ingot to prevent gasses from the external atmosphere from entering the melting chamber during initial startup of the continuous casting process. To that effect, the furnace of the present invention includes a vacuum seal assembly 180 which includes a rigid passage wall or collar 182 typically formed of metal and defining a passage 184 having a lower exit end 186 which communicates with ambient atmosphere external to the furnace and an upper entry end 188 which communicates with passage 48 whereby passages 184 and 48 form a single passage. Collar 182 has an inner periphery 189 which defines the passage 184 and in the exemplary embodiment is substantially cylindrical although it may have any suitable shape. Upper and lower high temperature polymer based sealing rings typically in the form of elastomeric O-rings 190 and 192, and a ceramic braided sleeve 194 are disposed along passage 184 to provide three flexible, removable annular sealing members respectively within annular grooves 196A-C which are formed in collar 182 and extend outwardly from inner periphery 189. O-rings 190 and 192 in the exemplary embodiment are formed of a high temperature silicone material. Other suitable sealing rings which are commonly available include buna or viton rings. Each O-ring 190 and 192 extends radially inwardly from inner periphery 189 and has an inner periphery 198 defining an O-ring passage 200. Likewise, ceramic braided sleeve 194 extends radially inwardly from inner periphery 189 and has an inner periphery 202 defining a sleeve passage 204. The transverse cross-sectional shape of passages 200 and 204 are substantially the same as that of narrower section 60 defined by the inner periphery of flange 54 and that of mold passage or cavity 26 defined by its inner surface 24. The transverse cross sectional shapes of passages 200 and 204 are slightly smaller than that of cavity 26 of mold 22 and also smaller than that of narrower section 60, which as previously noted is slightly larger than that of cavity 26. Lower O-ring 192 is spaced downwardly from upper O-ring 190 so that passage 184 includes a first passage segment 206 extending from the bottom of upper O-ring 190 to the top of lower O-ring 192. Likewise, ceramic braided sleeve 194 is spaced downwardly from lower O-ring 192 so that passage 184 includes a second passage segment 208 which extends from the bottom surface of O-ring 192 to the top surface of sleeve 194. Upper and lower gas inlet ports 210 and 212 are formed in collar 182 extending from its outer surface to inner periphery 189. Ports 210 and 212 are in fluid communication with passage 184 and an inert gas supply 214 via a gas conduit 216 connected to and extending therebetween. Supply 214 includes means for providing inert gas from supply 214 via conduit 216 to passage 184 at a low pressure which nonetheless exceeds the ambient atmospheric pressure and thus the pressure of the ambient reactionary gas external to the furnace. Thus, gas supply 214 may include a low pressure pump or a tank which is suitably pressurized by an air compressor or the like. Gas supply 214 is also in communication with melting chamber 16 via a gas feed conduit 218. A vacuum mechanism 220 is also provided external to melting chamber 16 and is in communication therewith via gas conduit 222 for the purpose of evacuating chamber 16.

Figure 18:
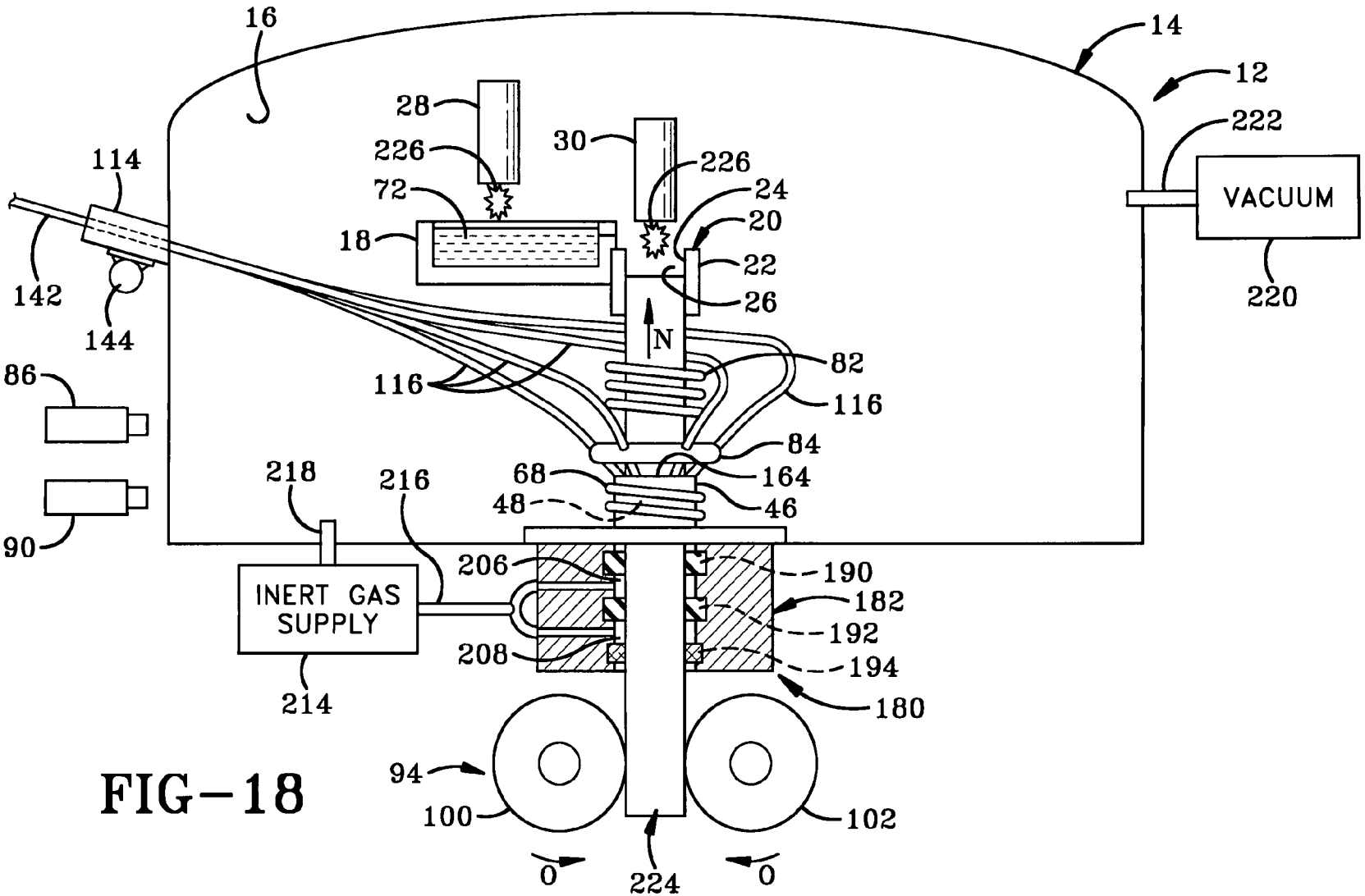
FIG. 18 is similar to FIG. 15 and shows the starter ingot stub having been inserted through the vacuum seal flange and into the continuous casting mold within the melting chamber.

The operation of furnace 12 during initial startup is now described with reference to FIGS. 18-20. Referring first to FIG. 18, a machined starter ingot stub 224 is inserted upwardly (arrow N) along the metal casting pathway through passage 184 and the passages defined by ceramic braided sleeve 194 and O-rings 190 and 192, passage 48, the passage circumscribed by cooling ring 84, heating coil 82 and into cavity 26 of mold 22. Starter stub 224 is machined so that its transverse cross sectional shape is the same as that of cavity 26 and only a very small degree smaller so that it forms a reasonably snug fit within cavity 26 as it slides upwardly therein. Rollers 100 and 102 are operated as shown at arrows O in FIG. 18 in order to effect the upward movement of starter stub 224. Once the starter stub 224 has been inserted in this manner, O-rings 190 and 192 form an airtight seal around the outer periphery of stub 224. Once starter stub 224 is inserted as shown in FIG. 18, low pressurized inert gas from gas supply 214 is supplied to segments 206 and 208 of passage 184 via conduit 216 and inlets 210 and 212. More particularly, the inert gas moves into the respective annular portions of segments 206 and 208 which circumscribe the outer periphery of starter stub 224 after its previously described insertion. More particularly, the annular portion of segment 206 into which the inert gas moves is defined between upper and lower O-rings 190 and 192, the outer periphery of starter stub 224 (or the metal casting pathway) and passage wall inner periphery 189. Likewise, the annular portion of segment 208 into which inert gas moves is defined between the bottom of O-ring 192, the top of annular sleeve 194, the outer periphery of starter stub 224 (or the metal casting pathway) and the passage wall inner periphery 189.

The cross sectional transverse shapes of passages 200 of O-rings 190 and 192 are, prior to insertion of starter stub 224, substantially the same as and slightly smaller than that of starter stub 224. The resilient compressible characteristics of the O-rings 190 and 192 allow them to expand slightly as starter stub 224 is inserted in order to match the cross sectional size of stub 224 and provide the gas tight seal previously noted. O-rings 190 and 192 are formed of a material which is impermeable to the inert gas. The cross sectional shape of sleeve 194 is very nearly the same as that of starter stub 224 and although it does not provide a gas tight seal, it does generally eliminate the vast majority of gas which may move from one side to the other of sleeve 194. Thus, it substantially minimizes the inert gas which would otherwise flow from segment 208 of passage 184 into the external atmosphere. Sleeve 194 is formed of a material which is permeable to the inert gas. Thus, inert gas may be exhausted from the annular portion of space 208 to the other side of sleeve 194 by passing through the pores of the material forming sleeve 194, between the inner periphery of sleeve 194 and outer periphery of starter stub 224, and also between the outer periphery of sleeve 194 and inner periphery 189 of the passage wall.

Once the gas tight seal is formed between starter stub 224 and O-rings 190 and 192, vacuum mechanism 220 is operated in order to evacuate the air from melting chamber 16. Typically, melting chamber 16 is evacuated to a base level below 100 millitorr and a leak rate of less than 30 millitorr within three minutes. The seal provided by the O-rings allows this to occur. Even though O-rings 190 and 192 are configured to provide a gas tight seal, or a substantially gas tight seal when the atmosphere within chamber 16 is at atmospheric pressure or under vacuum, the substantial reduction of pressure within chamber 16 may allow some leakage of gas into chamber 16 between starter stub 224 and O-rings 190 and 192 or between inner periphery 189 and said O-rings. Thus, the inert gas supplied to passage 184 is intended to allow only inert gas to enter melting chamber 16 via this potential leakage location, and thus not allow any air from the external atmosphere to enter melting chamber 16 around starter stub 224. After the melting chamber is evacuated and checked to ensure that the leak rate is limited to an acceptable level, the furnace is then back filled with inert gas from supply 214 via conduit 218. Melting chamber 16 is monitored to insure oxygen and moisture concentrations are sufficiently low to prevent contamination.

If these concentrations meet quality control standards, melting hearth plasma torch 28 is lit or ignited to form a plasma plume 226 to begin heating and melting the solid feed material within melting hearth 18 which is to be used for forming the metal ingot. Induction coils 68 and 82 are then powered for respectively inductively heating passage wall 46 and starter stub 224. Heat sensors 86 and 90 are used to respectively to monitor and control the temperature to which starter stub 224 and passage wall 48 are preheated. Although the exact temperature may vary with the specific circumstances, in the exemplary embodiment, starter stub 224 is preheated to approximately 2000° F. while reservoir passage wall 46 is preheated to a temperature of about 1700° F. to 1800° F. The mold plasma torch 30 is also lit or ignited to form its plasma plume 226 for heating the top of starter stub 224. Torch 30 may be used in the preheating process of starter stub 224. In addition, torch 30 is used to melt the top portion of starter stub 224 after which molten metal 72 is poured from hearth 18 into mold 20 to begin casting metal casting 34 so that stub 224 and casting 34 together form an ingot.

Figure 19:
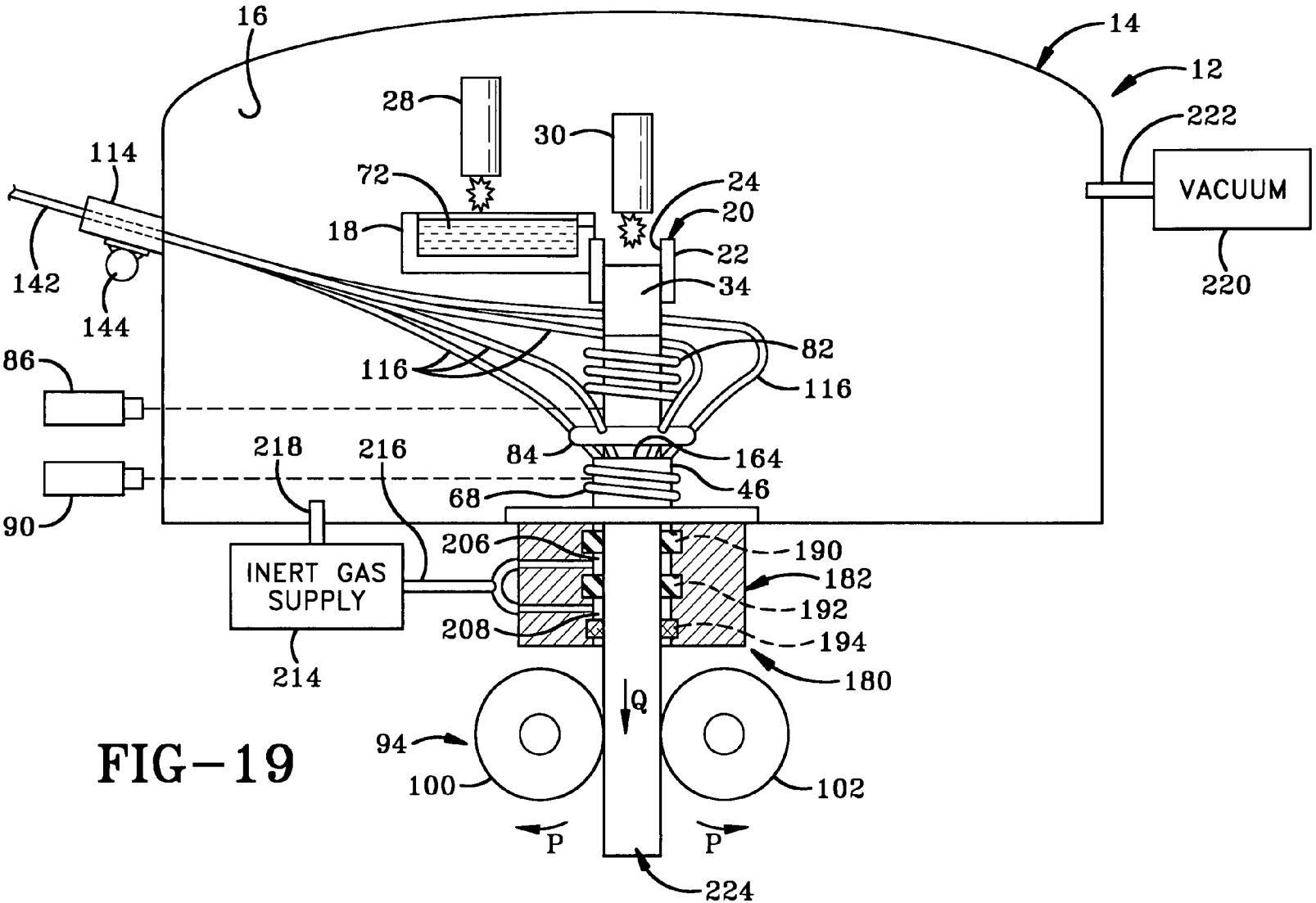
FIG. 19 is similar to FIG. 18 and shows an early stage of ingot formation atop the ingot starter stub.

As shown in FIG. 19, rollers 100 and 102 are rotated (arrows P) in order to lower (arrow Q) starter stub 224 and the metal casting 34 which is being formed atop starter stub 224 as molten material 72 is poured into mold 22 and solidified therein. Throughout this process, inert gas is continuously provided from supply 214 into passage 184 to ensure that there is no entry of the external atmosphere gasses such as oxygen and nitrogen into melting chamber 16.

Figure 20:
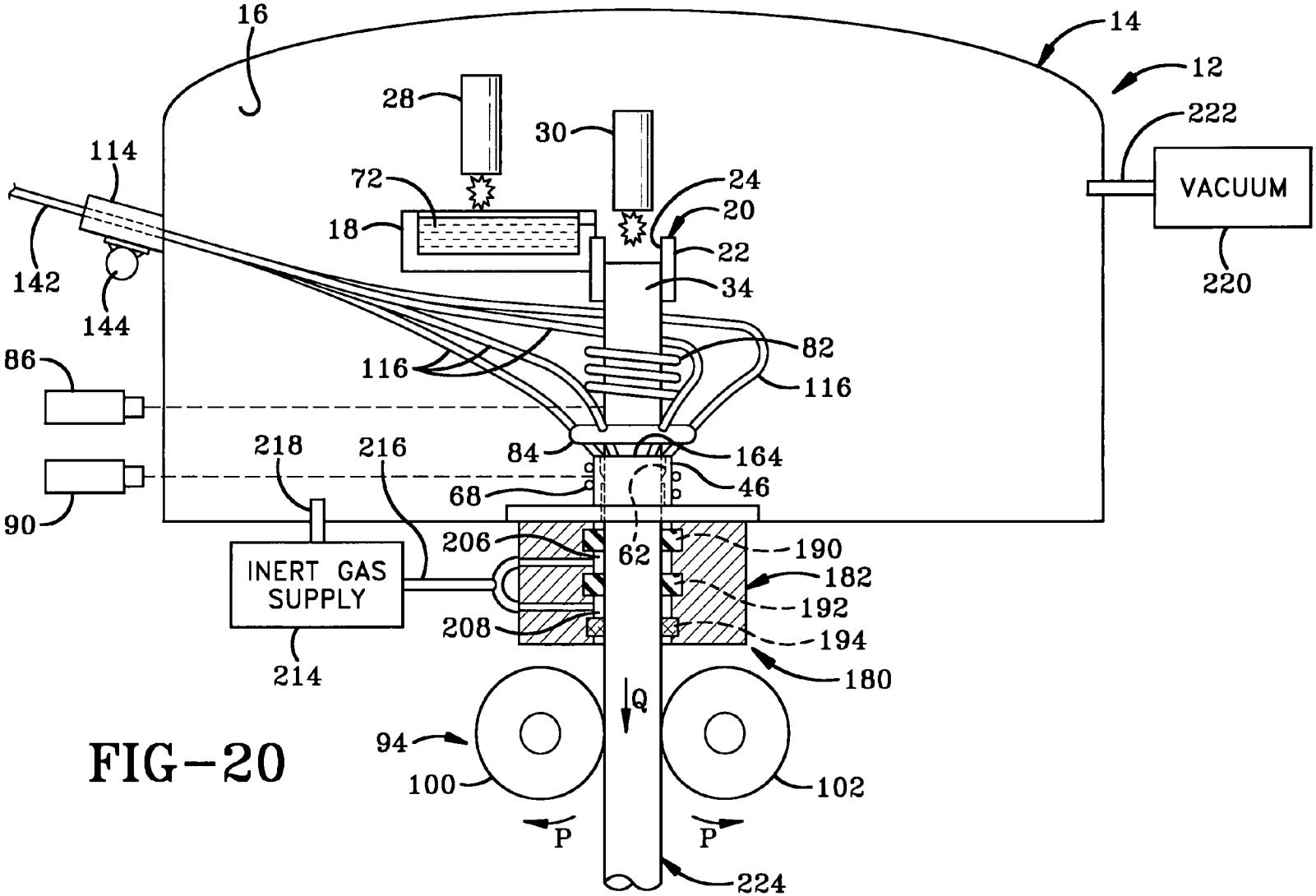
FIG. 20 is similar to FIG. 19 and shows a further stage of ingot formation and the initial formation of the molten seal.

As shown in FIG. 20, starter stub 224 and metal casting 34 are lowered until what is typically the hottest zone of the ingot—which may be a portion of starter stub 224 and/or metal casting 34—reaches reservoir 62, at which time rollers 100 and 102 are stopped in order to stop the movement of the ingot. While the ingot is stopped, particles 74 of coating material are fed into reservoir 62 as previously described with reference to FIGS. 11-14. Particles 74 are fed into reservoir 62 to a suitable level within about one minute. Typically it takes only about another minute to melt particles 74 in order to form the molten seal previously described within the reservoir 62. Thus, the lowering of the ingot is typically only stopped for about this two minute period to allow for the initial filling and melting of particles 74 within reservoir 62. While the ingot may need to be stopped for a longer period, this is typically no longer than about five minutes prior to initiating withdrawal of the ingot once again. This stopping period is needed in order to form a sufficient amount of molten material to provide the molten seal. That is, continued withdrawal of the ingot without this stopping period does not allow sufficient time to build up the needed volume of molten material to form the molten seal since the coating material making up the seal would exit the bottom of the reservoir at a rate which is too rapid to allow sufficient build up of molten material within reservoir 62. As noted above, this stopping period is nonetheless limited in duration in order to ensure that there is a sufficient heat energy from the metal casting 34 to melt particles 74 and keep the molten seal in a molten state.

When the starter stub and metal casting 34 is initially withdrawn after this stopping period, the withdrawal rate is relatively slow, and typically less than 1.0 inch per minute. The lowering of the ingot at this slower rate typically occurs for about ten minutes. The use of this slower withdrawal rate is related to the above noted need to maintain sufficient heat energy from the metal casting to melt particles 74 and keep them in a molten state. Once the molten seal is formed, there is no longer a need for the O-rings 190 and 192 to provide a seal to prevent external atmosphere from entering melting chamber 16, and thus no longer a need to provide inert gas into passage 184. Thus, movement of inert gas into passage 184 is stopped once the molten seal is formed. Once the slower ingot withdrawal is over, the ingot withdrawal rate is then accelerated to a rate typically greater than 1.0 inch per minute with a typical maximum rate of about 3.0 inches per minute.

As the ingot is lowered, particles 74 are fed at a sufficient rate to maintain the molten seal within reservoir 62 at a suitable level. The particle 74 feed rate is tied to the linear velocity of withdrawing casting 34 in order to maintain the volume of the molten material forming the molten seal at approximately the same level throughout the process although there is some room for variation as long the molten seal is maintained. More particularly, a faster withdrawal rate of metal casting 34 uses molten material from the molten seal more quickly in forming the coating around the metal casting and thus requires a relatively faster feed rate of particles 74 while a relatively slower withdrawal rate uses molten material from the molten seal less rapidly and thus requires a less rapid feed rate of particles 74 to maintain the molten seal. The rest of the casting process also continues at a controlled rate, and thus solid feed material is fed as needed into melting hearth 18 and melted therein to pour molten material into the continuous casting mold at the desired rate. The casting of metal casting 34 and the application of the coating material to the outer periphery of the metal casting via the molten seal continues as previously described.

When an entire campaign of casting is completed (which can easily last for six or seven days or more) O-rings 190 and 192 and ceramic braided sleeve 194 are removed and replaced in order to set up the furnace for a new campaign of continuous casting. Although the O-rings of the present invention are intended for temporary operation under the high temperatures involved during the start up process to provide the needed seal until the molten seal is formed, they nonetheless are not suitable for a long term continuous casting campaign, and thus will have deteriorated to a degree that they need to be replaced for initial startup of subsequent casting. Indeed, the sealing rings 190 and 192 typically will only provide the needed seal for less than one hour, most typically about ½ hour or so. While the ceramic braided sleeve 194 is configured for even higher temperature use, (for example, over 2000° F.) for longer periods it nonetheless needs to be replaced prior to setting up for a new campaign of casting. Although ceramic braided sleeve 194 might otherwise last longer, the interaction with the coating applied to the outer periphery of metal casting 34 degrades ceramic braided sleeve 194 to the degree that it needs to be replaced.

It is noted that the volume of molten material in the molten seal is relatively small and typically no more than can be melted during the previously noted stopping period in which the ingot is stopped in order to feed particles 74 into reservoir 62 and melt them to form the molten seal. One reason for keeping the volume of the molten material and molten seal to a relative minimum is to limit the amount of energy used to provide the necessary temperature for this melting process. In addition, the minimal volume is advantageous when the furnace needs to be shut down in a controlled manner. The shutdown of the furnace involves shutting off the flow of particles 74 along the particle feed pathway to reservoir 62. Ceasing the flow of particles 74 into reservoir 62 may be achieved almost immediately or within a relatively few seconds in order to quickly reach a state in which the volume of molten material in reservoir 62 is not increased. The shutdown of the furnace obviously also includes cessation of pouring additional molten material into mold 22. The metal casting 34 is lowered relatively quickly in order to ensure that the molten material forming the molten seal within reservoir 62 does not solidify prior to complete removal of the ingot therefrom. Thus, the temperature of the portion of metal casting 34 passing through reservoir 62 during this shutdown process should not decrease to below the melting temperature of particles 74. In the exemplary embodiment this temperature is about 1400° F., which is the approximate melting temperature of the glass particles which are typically used in making up particles 74. However, this temperature will obviously vary depending upon what material is used to form particles 74. When this portion of metal casting 34 does decrease below said melting temperature, the metal casting will become stuck and effectively weld itself to passage wall 46 along the annular flange forming the bottom of reservoir 62. The furnace would thus require a substantial amount of time for repair and removal of the ingot therefrom.

It is noted that alternate start up assemblies may be used in order to prevent external atmosphere from entering the melting chamber prior to the formation of the molten seal. However, such a start up assembly is more complicated than the one described above and creates its own problems. More particularly, a lower sealed chamber may be formed below the melting chamber which includes a rigid wall or door which may be closed to form the sealed condition of the lower chamber and opened or removed to open communication between the lower chamber and the external atmosphere. Such a configuration would require a larger annular sealing member which would not contact the outer periphery of the ingot but rather contact and form an airtight seal between the door and other rigid walls such as the bottom wall of the melting chamber or a rigid structure extending downwardly therefrom. Such a start up assembly would thus require that the melting chamber and the lower chamber both be evacuated and then back filled with inert gas prior to formation of the molten seal. Once the molten seal used with such a start up apparatus is formed, the sealed chamber can be opened to the external atmosphere by opening of the door to break the initial seal. In order to proceed with the continuous casting of the ingot using the molten seal, the door would thus have to be moved out of the metal casting pathway extending below the melting chamber. While the use of such a start up assembly is possible, it is relatively cumbersome and requires a substantial amount of additional structure compared to the use of vacuum seal assembly 180. The use of such a lower chamber may tend to cause the process to slow down, which can be problematic in keeping the metal casting at a desired temperature for melting the particles of coating material as previously discussed. While the lower chamber could be made substantially larger in order to minimize the problems related to slowing down the withdrawal of the ingot, doing so would add to the length of the lower chamber required. In addition, the size of the lower chamber would need to be large enough to accommodate the lowering mechanism such as rollers 100 and 102 in order to control the insertion of the starter stub as well as the withdrawal of the ingot. The use of vacuum seal assembly 180 eliminates these problems and the various structures and the lower chamber which would be required in order to create such a start up assembly.

Thus, furnace 12 provides a simple apparatus for continuously casting and protecting metal castings which are reactionary with external atmosphere when hot so that the rate of production is substantially increased and the quality of the end product is substantially improved.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A method comprising the steps of:

positioning first and second spaced annular sealing members abutting and extending radially inwardly from a passage wall inner periphery which defines a passage which communicates with an interior chamber containing a continuous casting mold and with atmosphere external to the interior chamber, the passage comprising a molten seal reservoir between the mold and the sealing members;

inserting an ingot starter stub through the sealing members and molten seal reservoir into the interior chamber so that an upper end of the stub is disposed in the mold and each of the sealing members abuts an outer periphery of the starter stub so that at least one of the sealing members forms a substantially airtight seal with the outer periphery of the starter stub; and moving inert gas into a first space defined between the sealing members, the outer periphery of the starter stub and the passage wall inner periphery moving the inert gas through a gas inlet port which is formed in the passage wall and extends from an outer surface of the passage wall to the inner periphery of the passage wall between the first and second sealing members.

2. The method of claim 1 wherein one of the sealing members is formed of a ceramic braided material.

3. The method of claim 2 further comprising the step of exhausting inert gas from the first space into the external atmosphere through the ceramic braided material.

4. The method of claim 1 wherein the step of inserting comprises the step of inserting the ingot starter stub through the sealing members so that each of the sealing members forms a substantially airtight seal with the outer periphery of the starter stub.

5. The method of claim 1 wherein the step of inserting comprises the step of inserting the ingot starter stub through the sealing members so that the first sealing member forms a substantially airtight seal with the outer periphery of the starter stub and the second sealing member does not form an airtight seal with the outer periphery of the starter stub; and further comprising the step of moving inert gas from the first space between the second sealing member and the outer periphery of the starter stub.

6. The method of claim 1 wherein the second sealing member is formed of a material which is permeable to the inert gas; and further comprising the step of moving inert gas from the first space through the material which forms the second sealing member.

7. The method of claim 1 wherein the step of moving comprises the step of moving inert gas into the first space at a pressure in excess of the pressure of the ambient atmosphere external to the interior chamber.

8. The method of claim 1 further comprising the step of evacuating air from the interior chamber after the step of inserting.

9. The method of claim 8 further comprising the step of backfilling the evacuated interior chamber with inert gas.

10. The method of claim 9 further comprising the step of pouring molten metal into the mold atop the starter stub to initiate formation of a heated metal casting atop the starter stub whereby the metal casting and starter stub together form an ingot.

11. The method of claim 10 further comprising the steps of transferring solid particulate material into the molten seal reservoir; and melting the particulate material in the reservoir to form a molten seal around an outer periphery of the ingot.

12. The method of claim 11 wherein the steps of transferring and melting occur when the ingot is not being withdrawn through the passage.

13. The method of claim 12 further comprising the step of withdrawing the ingot through the passage for a first time period; and stopping withdrawal of the ingot through the passage for a second subsequent time period; and wherein the steps of transferring and melting occur during the second time period.

14. The method of claim 13 wherein the second time period has a duration of at least one minute.

15. The method of claim 14 wherein the second time period has a duration of no more than five minutes.

16. The method of claim 13 further comprising the step of restarting withdrawal of the ingot at the end of the second time period at a rate of less than 1.0 inch per minute for a third time period.

17. The method of claim 16 further comprising the step of accelerating withdrawal of the ingot at the end of the third time period to a rate of more than 1.0 inch per minute for a fourth time period.

18. The method of claim 17 wherein the rate of withdrawal during the fourth time period is no greater than 3.0 inches per minute.

19. The method of claim 1 wherein the step of moving comprises moving the inert gas from an inert gas supply into the gas inlet port via a conduit which is connected to and extends outwardly from the outer surface of the passage wall.

20. A method comprising the steps of:

positioning first and second spaced annular sealing members abutting and extending radially inwardly from a passage wall inner periphery which defines a passage which communicates with an interior chamber containing a continuous casting mold and with atmosphere external to the interior chamber, the passage comprising a molten seal reservoir between the mold and the sealing members;

inserting an ingot starter stub through the sealing members and molten seal reservoir into the interior chamber so that an upper end of the stub is disposed in the mold and each of the sealing members abuts an outer periphery of the starter stub so that at least one of the sealing members forms a substantially airtight seal with the outer periphery of the starter stub; and moving inert gas into a first space defined between the sealing members, the outer periphery of the starter stub and the passage wall inner periphery;

wherein the step of positioning comprises the step of positioning a third annular sealing member within the passage so that the first and second sealing members are between the reservoir and the third sealing member, and the second sealing member is between the first and third sealing members; and the step of inserting comprises the step of inserting the starter stub through the third sealing member so that the third sealing member abuts the outer periphery of the starter stub.

21. The method of claim 20 further comprising the step of moving inert gas into a second space defined between the second and third sealing members, the outer periphery of the starter stub and the passage wall inner periphery.

22. The method of claim 21 further comprising the step of exhausting inert gas from the second space into the ambient atmosphere through the third sealing member.

23. The method of claim 20 wherein the third sealing member is formed of a ceramic braided material.

24. The method of claim 23 wherein each of the first and second sealing members is formed of a polymer based material.

25. The method of claim 20 wherein the step of moving inert gas into the first space comprises moving the inert gas through a gas inlet port which is formed in the passage wall and extends from an outer surface of the passage wall to the inner periphery of the passage wall between the first and second sealing members.

26. The method of claim 25 further comprising the step of moving additional inert gas into a second space defined between the second and third sealing members, the outer periphery of the starter stub and the passage wall inner periphery by moving the additional inert gas through a gas inlet port which is formed in the passage wall and extends from an outer surface of the passage wall to the inner periphery of the passage wall between the second and third sealing members.

27. The method of claim 8 further comprising the step of moving additional inert gas into a second space defined between the second and third sealing members, the outer periphery of the starter stub and the passage wall inner periphery by moving the additional inert gas through a gas inlet port which is formed in the passage wall and extends from an outer surface of the passage wall to the inner periphery of the passage wall between the second and third sealing members.

28. A method comprising the steps of:

positioning an annular sealing member abutting and extending radially inwardly from a passage wall inner periphery which defines a passage which communicates with an interior chamber containing a continuous casting mold and with atmosphere external to the interior chamber, the passage comprising a molten seal reservoir between the mold and the sealing member;

inserting an ingot starter stub through the sealing member and molten seal reservoir into the interior chamber so that an upper end of the stub is disposed in the mold and the sealing member abuts and forms a substantially airtight seal with the outer periphery of the starter stub to prevent the external atmosphere from entering the interior chamber via the passage;

evacuating air from the interior chamber after the step of inserting;

supplying inert gas adjacent the sealing member so as to allow leakage of the inert gas around the outer periphery of the starter stub past the sealing member through the passage into the interior chamber during the step of evacuating;

backfilling the evacuated interior chamber with inert gas;

pouring molten metal into the mold atop the starter stub to initiate formation of a heated metal casting atop the starter stub whereby the metal casting and starter stub together form an ingot; and forming a molten seal within the reservoir around an outer periphery of the ingot which prevents the external atmosphere from entering the interior chamber via the passage whereby the seal between the sealing member and the outer periphery of the starter stub is no longer necessary to prevent the external atmosphere from entering the interior chamber via the passage.

29. The method of claim 28 further comprising the steps of stopping the step of supplying inert gas adjacent the sealing member once the molten seal is formed;

pouring additional molten metal into the mold to continue forming the ingot; and, as the ingot continues to be formed, withdrawing the ingot from the interior chamber through the passage while the movement of inert gas into the passage remains stopped.

30. The method of claim 28 wherein the step of backfilling comprises backfilling the evacuated interior chamber with inert gas to provide within the interior chamber an inert atmosphere consisting essentially of inert gas; and further comprising the step of maintaining the inert atmosphere within the interior chamber during the step of pouring.

31. The method of claim 28 wherein the leakage is leakage only of the inert gas.

* * * * *

UNITED STATES PATENT AND TRADEMARK OFFICE

CERTIFICATE OF CORRECTION

PATENT NO. : 7,926,548 B2
APPLICATION NO. : 12/283226
DATED : April 19, 2011
INVENTOR(S) : Michael P. Jacques et al.

It is certified that error appears in the above-identified patent and that said Letters Patent is hereby corrected as shown below:

Column 18, line 41 (Claim 27) change the phrase "The method of claim 8 further" to --The method of claim 20 further--

Signed and Sealed this
Sixteenth Day of August, 2011

David J. Kappos

David J. Kappos
*Director of the United States Patent and Trademark Office*